US007551161B2

(12) United States Patent
Mann

(10) Patent No.: US 7,551,161 B2
(45) Date of Patent: Jun. 23, 2009

(54) FLUID USER INTERFACE SUCH AS IMMERSIVE MULTIMEDIATOR OR INPUT/OUTPUT DEVICE WITH ONE OR MORE SPRAY JETS

(76) Inventor: W. Stephen G. Mann, c/o N1NLF, University of Toronto, Dept. E.C.E., 10 King's College Road, Room 2001, Toronto, Ontario (CA) M5S 3G4

( * ) Notice: Subject to any disclaimer, the term of this patent is extended or adjusted under 35 U.S.C. 154(b) by 635 days.

(21) Appl. No.: 11/302,504

(22) Filed: Dec. 14, 2005

(65) Prior Publication Data

US 2006/0144213 A1 Jul. 6, 2006

(30) Foreign Application Priority Data

Dec. 30, 2004 (CA) ..... 2499784
Sep. 9, 2005 (CA) ..... 2517501

(51) Int. Cl.
*G09G 5/00* (2006.01)

(52) U.S. Cl. ..... 345/156; 84/616; 84/647

(58) Field of Classification Search ..... 345/156; 84/616, 647

See application file for complete search history.

(56) References Cited

U.S. PATENT DOCUMENTS

2007/0093306 A1 4/2007 Magee et al.

*Primary Examiner*—Richard Hjerpe
*Assistant Examiner*—Leonid Shapiro

(57) ABSTRACT

A fluid user interface is presented for applications such as immersive multimedia. In one embodiment, one or more sprays or jets create an immersive multimedia environment in which a participant can interact within the immersive multimedia environment by blocking, partially blocking, diverting, or otherwise engaging with a fluid, to create computational input. When the fluid is air, a keyboard can be implemented on cusions of air coming out of various nozzles or jets. When the fluid is water, the invention may be used in environments such as showers, baths, hot tubs, waterplay areas, gardens, and the like to create a fun, playful, or wet user-interface. In some embodiments, the spraying is computationally controlled, so that the spray creates a tactile user-interface for the control of such devices as new musical instruments. These may be installed in public fountains to result in a fluid user interface to music by playing in the fountains. The invention may also be used in a setting like a karaoke bar, in which participants perform music by playing in a fountain while they sing. Small self contained embodiments of the invention may exist as pool toys, bath toys, or decorative fountains that can sit on desk tops, or the like.

24 Claims, 14 Drawing Sheets

FLUID USER INTERFACE SUCH AS IMMERSIVE MULTIMEDIATOR OR INPUT/OUTPUT DEVICE WITH ONE OR MORE SPRAY JETS

FIELD OF THE INVENTION

The present invention pertains generally to a new kind of input/output device that may be used to control a computer or a musical instrument, or that may itself be a device such as a musical instrument or multimedia sculpture.

BACKGROUND OF THE INVENTION

Many traditional user-interfaces, human-computer interfaces, and the like, are cold, mechanical/tegical and lack an expressive continuous "fluid" and immersive form of interaction.

Some user-interfaces, such as proximity-based, or antenna-based musical instruments like the Theremin, or "Doppler Danse" (Steve Mann "Doppler Danse", Leonardo, Vol. 25, Iss. 1, 1992), achieve the desirable more continuous and immersive form of interaction but lack tactile feedback.

Likewise, "air typing" keyboards suffer from similar problems, as do many of the vision-based systems such as David Rokeby's "Very Nervous System" (a vision-based system that uses a camera as an input device to control virtual musical instruments, by tracking people's body position in space).

Playing these instruments is very difficult because they provide no "feel" of where individual notes are located.

SUMMARY OF THE INVENTION

The following briefly describes my new invention.

It is possible with this invention to provide a more "fluid" as well as a more continuous and "immersive" multimedia input device with input elements that a user can feel.

It is possible with this invention to provide a Theremin-like musical instrument or other input device but one in which the user has some feel, that is provided by a fluid that is instrumental in the interaction, or in which a tactualization is formed by a descrete set of holes for notes.

It is possible with the invention to select from a discrete or continuous alphabet of symbols, using a body of air or water as an input device, or using a discrete set of holes as an alternative form of tactualizer.

It is possible in embodiments that use a fruit, that this fluid can also be part of a closed-loop interaction.

It is possible that the fluid can be optically and visually engaging, as well as tactile.

The following provides an informal review/summary of my new invention.

The invention can be incorporated into pool toys, bath toys, small decorative desktop/tabletop fountains, hot tubs, larger public fountains, municipal swimming baths, the towers (platforms, such as a 5-meter platform or a 10-meter platform) at swimming baths, as well as in small portable devices that can be connected to a garden hose, or to a small pump to draw fluid from an ocean, lake, hot tub, bath tub, or the like.

One aspect of the invention allows a bather to press down on a spray jet of fluid, to play different musical notes, the notes depending on a manner in which the fluid flow is restricted. In addition to music, other functions such as a combination input/output (keyboard/display) in water are possible.

One aspect of the invention creates a flat sheet of water that functions as a "splash page" to display a web page, projected onto the flat sheet of water, such that a bather can touch part of the sheet of water to select something from the web page.

Another aspect of the invention uses a pool as the splash page, with scoffing multimedia matter projected onto the pool, or the bottom of the pool, so that a bather can enter the pool (possibly with the entire body, as, for example, from a 5-meter or 10-meter platform) to select something from the pool.

The splash page can also be made from a two dimensional array of jets with means for sensing restriction of individual jets in the array.

The apparatus of the invention allows the user to convey information in a very poetic, expressive, continuous, fluid way, and also for information to be presented to the user in a natural manner.

BRIEF DESCRIPTION OF THE DRAWINGS

The invention will now be described in more detail, by way of examples which in no way are meant to limit the scope of the invention, but, rather, these examples will serve to illustrate the invention with reference to the accompanying drawings, in which.

DETAILED DESCRIPTION OF THE PREFERRED EMBODIMENTS

Figure 1A:
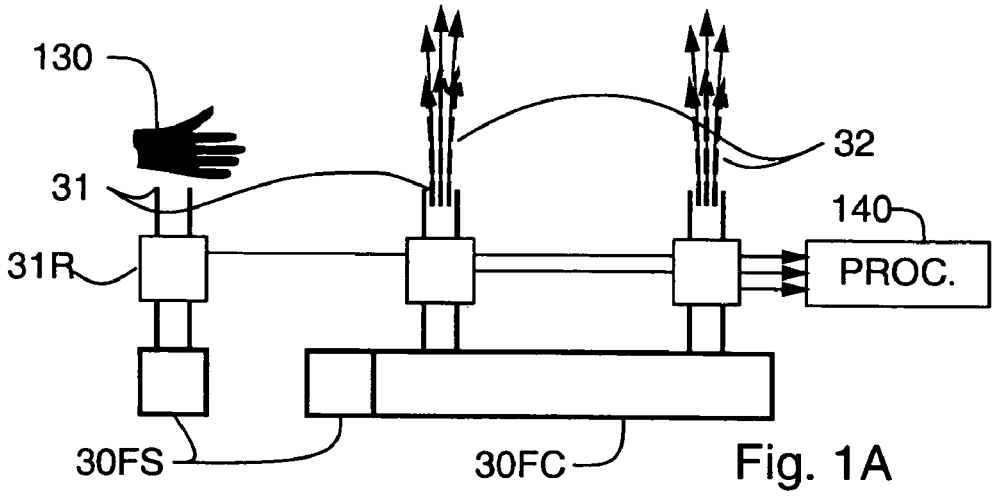
FIG. 1A illustrates the principle and components of the invention where separate restrictometers are used.

While the invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

In all aspects of the present invention, references to "camera" mean any device or collection of devices capable of simultaneously determining a quantity of light arriving from a plurality of directions and or at a plurality of locations, or determining some other attribute of light arriving from a plurality of directions and or at a plurality of locations.

References to "processor", or "computer" shall include sequential instruction, parallel instruction, and special purpose architectures such as digital signal processing hardware, Field Programmable Gate Arrays (FPGAs), programmable logic devices, as well as analog signal processing devices.

When it is said that object "A" is "borne" by object "B", this shall include the possibilities that A is attached to B, that A is part of B, that A is built into B, or that A is B.

FIG. 1A illustrates an acoustic air-based embodiment of the invention.

One or more fluid chests 30FC supply fluid (such as air, or water) to one or more fluid jets 31. Fluid jets 31 may be nozzles, spray jets, water jets, air jets, etc., that can be interacted with by a user of the apparatus of the invention.

Each jet has, associated with it, a restrictometer 31R, that measures the degree to which the flow of the jet is being restricted. In some embodiments of the invention, the restrictometer provides a continuous measure of restriction, whereas in other embodiments the measurement is discrete (digital). When the measurement is discrete (digital) the restrictometer 31R senses which of a discrete set of restrictometric states the the flow of jet 31 is in. For example, the restrictometer may sense that jet 31 is in one of four states: no flow, low flow, medium flow, or high flow. In other embodiments, the restrictomter 31R simply senses whether or not the jet is blocked, and thus has only two states of sensory capability: on or off. In this situation, a flow switch is a satisfactory restrictometer 31 R. Alternatively, a pressure switch on the side-discharge of a "T" fitting as commonly used in plumbing systems, with the fluid going through the straight path of the "T" fitting, will make a satisfactory restrictometer.

The term "restrictometer" appears in the published scientific literature. See for example, "Image processing considerations for simple real-time fluid-based user interfaces", Steve Mann, in Proceedings of the IEEE International Conference on Image Processing (ICIP), paper number 1442, Lausanne, Switzerland, Sep. 11-14, 2005.

See also, "flUId streams: fountains that are keyboards with nozzle spray as keys that give rich tactile feedback and are more expressive and more fun than plastic keys", International Multimedia Conference archive Proceedings of the 13th annual ACM international conference on Multimedia, Hilton, Singapore Pages 181-190, 2005. ISBN:1-59593-044-2 Author: Steve Mann; Sponsors: ACM: Association for Computing Machinery, SIGGRAPH: ACM Special Interest Group on Computer Graphics and Interactive Techniques; SIGMULTIMEDIA: ACM Special Interest Group on Multimedia Publisher, ACM Press New York, N.Y., USA. Alternatively, a pressure sensor may be used on the side discharge of the "T" fitting. A number of flow meters are also suitable, such as a pinwheel flow meter, or even just a pump used in reverse as a generator to generate electricity when fluid is forced through it, thus measuring how much fluid is going through it.

If the sensing is binary (i.e. sensing only on and off states) it is preferable that it have some hysterisis, which can be achieved by quantizing a continuous sensor appropriately, or by using a snap switch (microswitch) on a bellows, diaphragm, membrane, flow lever, arm, or the like. Many magnetic reed switches also have hysterisis and are submersible. In the case of a magnetic reed switch, a simple diaphragm, to use pressure to move a magnet toward or away from the reed switch, will result in a suitable pressure switch. Alternatively, a flow switch can be implemented by a small paddle or flapper that swings a magnet near a magnetic reed switch to detect flow in the side-branch of the "T" fitting (i.e. to sense restriction of the main-branch).

Other sensory combinations for restrictometer 31R are also possible. For example, a diaphragm with a small mirror or other optical arrangement to measure flexing of the diaphragm can be used with a photocell and light source. Two or four photocells in a bridge can be used to convert from flow to resistance value, thus measuring restriction continuously.

A piece of surgical tubing can also be used to measure restriction because it will flex or bend when there are flow or pressure changes.

Finally, an optical restrictometer can be used, based on the optical properties of the fluid, especially with water, where the optical properties of the water cause it to act like a cylindrical lens. The restriction can thus be sensed by cameras, photocells, light detectors, or the like.

When restrictometer 31R is continuous rather than discrete, the instrument can be "velocity sensitive" like a piano, in which hitting the jets harder results in a louder sound.

However, it is preferable that restriction continually affect the amplitude of the sounded note, rather than having the instrument be velocity sensitive. In this way, the instrument works more like a tracker organ keyboard than like a piano keyboard. Rather than breaking the note down into initial setup by velocity, with possible further modification by aftertouch, it is preferable to have "duringtouch", i.e. a touch that starts, and continues, to be consistent. This consistency is provided by continually updating the note volume as a function of restriction. Ideally, therefore, all notes (or at least those over a certain restriction threshold) are always sounding, and the volume of each one is simply modulated with degree of restriction.

The restrictometer 31R can also be an expressive restrictometer that senses the way in which the fluid is blocked, such as for example to distinguish between. a hand that blocks it straight across and at an angle. A sonar, inside the fluid chest 30FC can, for example, "see" a return from the hand 130 of a user of the device. The restrictometer can thus sense the height of the water jet emerging from jet 31, as well as the manner in which it is blocked. Thus the restrictometer may, for example, be able to tell the difference between a 6 inch (152 mm) jet that is blocked straight at 3 inches (76 mm) and one that is blocked crooked at the same height of 3 inches (76 mm).

These restrictometric nuances can be passed along to processor 140 to synthesize a rich sound of a wonderfully complex musical instrument that responds to not just how far down a particular jet is pressed, but also to which way the jet is pressed. Thus the apparatus of the invention can work like a tracker organ (an organ that responds to how far down keys are depressed) with further expression effects such as pitch bend by blocking a jet at an angle in the direction of desired bend. Thus spraying fluid to the left (by selecting the angle of the hand 130, tilting the hand) may, for example, cause a downward bend in pitch. Spraying to the right can raise the pitch. Spraying up and down (i.e. toward or away from the user) can cause other effects such as continuous change in timbre.

When one jet is blocked, fluid 32 may emerge more quickly from other jets. Processor 140 can account for this change, and solve a plumbing network, using well known network solving algorithms, to make a more accurate inference of flow changes.

Alternatively, a separate fluid supply 30FS may be used for each jet, so that there is not a sharing of supply, so that fluid chest 30FC is eliminated. For example, there may be a pump for each jet 31.

In the diagrams, the jets are shown as single jets, but, in order to put expression into the music, the jets may be segmented. For example, a 12-jet instrument may typically include 24 or 48 restrictometers (two or four per jet), where the jet is segmented into halves or quarters, so that blocking the left side of a jet can be read differently than blocking the right side of the jet, etc.. Thus, for example, a musician can "bend" notes by blocking the left or right half of a jet. Blocking from top to bottom can change the timbre. Typically, blocking the bottom of a jet causes a deeper, more muted sound, or a more pure flute-like sound, whereas blocking the top of a jet causes a brighter more brassy sound, or a more bombarde-like sound, richer in harmonics. By moving the finger around the hole in different ways, a very richly expressive form of music can result. The resulting ability to sense a hydrodynamic flowfield can be used in different ways. Thus the sensory capabilities of each jet are multidimensional, with volume (amplitude) being on the "Z" axis (greater or lesser restriction along the central axis of symmetry of the round jet, for example), slight pitch bending (between notes) being affected by moving the finger a little bit along the "X" axis (side-to-side), and timbre being affected by moving the finger along the "Y" axis (up and down).

Figure 1B:
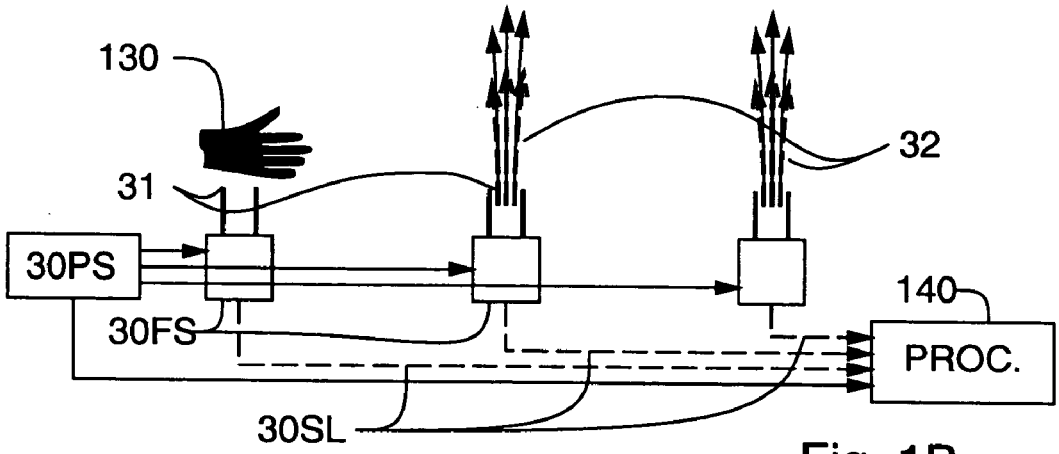
FIG. 1B illustrates the principle and components of the invention where the restrictometers are the fluid supplies, with a separate fluid supply for each fluid jet.

FIG. 1B illustrates an embodiment of the invention that does not use a fluid chest. Instead there is a fluid supply 30FS for each jet 31. Sense lines 30SL from each fluid supply 30FS pass along the information to processor 140 to indicate the degree of restriction on each of the jets 31.

These sense lines are shown as dotted lines, because they are often not necessary. Instead, a power supply 30PS that supplies the fluid supplies 30FS (e.g. a power supply that supplies a separate miniature pump for each jet) is an intelligent power supply that monitors power consumption on a per-pump basis. In this way, the pumps are each their own restrictometer, such that when a particular pump is blocked, the electrical consumption or other characteristics of the pump are monitored, and this information is used to sense the restriction of flow.

As an example, a small 12 volt submersible pump may draw 6 amps current when not blocked, but only 4 amps current when blocked the one third reduction in current can be sensed to trigger a note of a pitch that corresponds to a particular note on a musical scale in keeping with the position of the jet in a row of jets. The note can be sustained for as long as the jet is blocked. The volume of the note can be adjusted, for example, to full volume at 4 amps, to half volume at 5 amps, and to zero volume at 6 amps current draw by the pump associated with that particular note. If this affine relationship of current versus volume is not desired, a LookUp Table (LUT) can be used to shape the note volume as a function of flow restriction.

Power consumption of other devices can be similarly used. For example, power consumption of a steam boiler, ultrasonic atomizer, or the like, can be monitored to estimate restriction.

Alternatively, if the water is being heated, separate on-demand heaters for each jet can be monitored to estimate flow restriction. Heating of the jets is sometimes desired to make the instrument more comfortable to play.

In multi-pump embodiments of the invention, there can also be more than one pump per jet, in order to sense a hydrodynamic flowfield. For example, a 12-jet water-based instrument may have 48 pumps, with four pumps per jet, each group of four being arranged to spray into a quad-segmented jet.

Figure 1C:
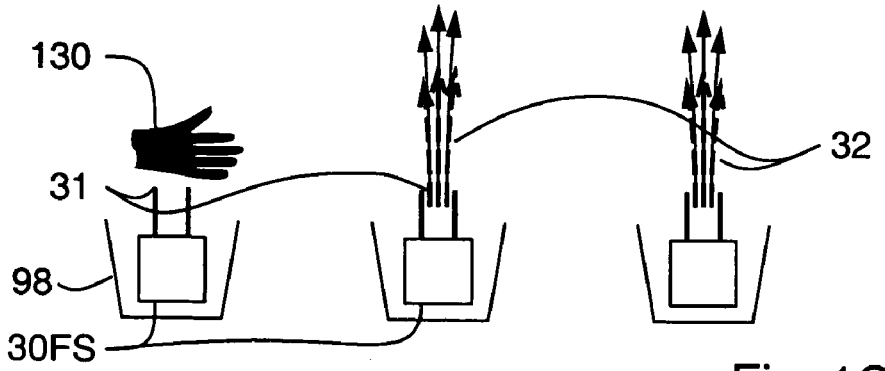
FIG. 1C illustrates an embodiment of the invention with a separate housing for each of a plurality of modules that each have a fluid supply, fluid jet, and restrictometer, each combined with either wireless communication or sound producing device.

FIG. 1C illustrates an embodiment of the invention that uses a separate housing 98 for each note. The housings might, for example, be flower pots, or similar pots as are commonly used for small decorative tabletop or desktop fountains. Each housing has a fluid supply 30FS which might, for example, be a pump, to spray fluid 32 out jet 31. The user touches, for example, by way of hand 130, each jet in succession to type or play music or for other forms of interaction.

The units housed in housings 98 may each contain a sound making device, of a specific pitch. For example, with 8 housings 98, a musical scale, such as A, B, C, D, E, F, G, a (natural minor) or C, D, E, F, G, A, b, c (major) may exist in the choice and design of soundmaking devices in each of the eight stand-alone units.

These can be manufactured as a set, or sold individually, so that a customer could buy the notes that he or she would like to have, and arrange these in a desired musical scale along a desktop. Each unit may have it's own batteries, if desired.

The units may have wireless communication that could be used to set the note's pitch for each unit.

In other forms of wireless communication, the units may interact in interesting ways. For example, two units may interact in a playful way, rather than as a musical instrument. When the user pushes down the jet one one, the other's jet turns on, and vice versa. When separated over distance, e.g. on two separate desktops of colleagues, co-workers, or spouses, the result is a playful way of interacting. With wireless repeaters, Internet connection, or the like, the interaction can embody a kind of waterfight across cyberspace, where there is a simple metaphor of "pushing water through cyberspace".

With this embodiment, or various other embodiments of the invention, radio buttons can be implemented in which all but one jet 31 initially sprays water, and pressing another jet causes that other jet to stay down. This feature could, for example, select from among various radio stations. For example, if a person had eight favorite radio stations, there could be eight jets but with only seven of them running. The one that's not running corresponds to the radio station playing. Pressing another jet down changes to that other radio station.

With wireless control of lighting and other equipment, the invention may thus be used to switch various lights on and off. For example, two jets may be used, so that pressing down on a first jet causes the first jet to turn off and a second jet to turn on, as well as the lights in the room to turn on. Pressing down on the second jet causes the second jet to turn off and the first jet to turn on, as well as causing the lights to turn off.

Figure 1D:
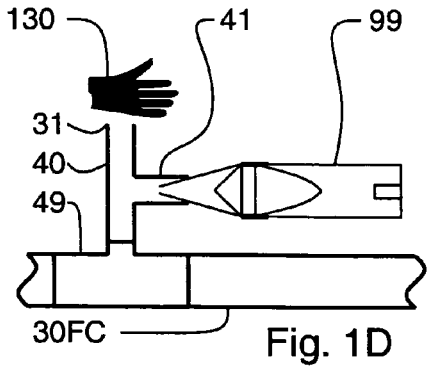
FIG. 1D illustrates the fluid diversion principle of the invention in which a fluid is diverted to cause sound production when a fluid jet is blocked.

FIG. 1D illustrates an acoustic air-based embodiment of the invention, showing just one note. A fluid chest 30FC delivers compressed air to a number of fluid jets 31. This can be accomplished by tapping into fluid chest 30FC with a reducing "T" fitting 49 for each tap point. For example, if there are to be 25 notes (for a 2-octave chromatic range), there would be 61 reducing "T" fittings 25, spaced along fluid chest 30FC.

The outlets from each of these reducing "T" fittings 49, are each connected to a regular (non-reducing) "T" fitting 40. Regular "T" fittings 40 are of a size compatible with the side outlet of reducing "T" fittings 49. For example, fluid chest 30FC might be a one inch (approx. 25 mm) copper pipe. Reducing "T" fittings 49 might be one by one quarter by one inch (approx. 25×6×25 mm) fittings, and regular (non-reducing) "T" fitting 40 might be a quarter by quarter by quarter inch (6×6×6 mm) "T" fitting.

When hand 130 descends to partially restrict flow out of one of 25 jets, such as jet 31, thus reducing the amount of air that comes out of that jet, a greater portion of air is forced out side discharge 41, than would be forced out when hand 130 is not present.

As jet 31 is restricted to a greater degree, more fluid (air in this case) flows out through side discharge 41, into a flow-based sound producing device 99. A satisactory sound producing device is an organ pipe, as commonly used in a pipe organ, such as the pipe organs commonly found in churches, convention centers, skating rinks, and the like. The sound-producing devices may be whistles, flutes, or other sound-makers that make sound when air is fed to them.

There may be various embodiments of the invention having various numbers of notes. In a 25 note (2-octave chromatic) version of the invention, there would be 25 sound producing devices 99, each tuned to the appropriate note.

Figure 1E:
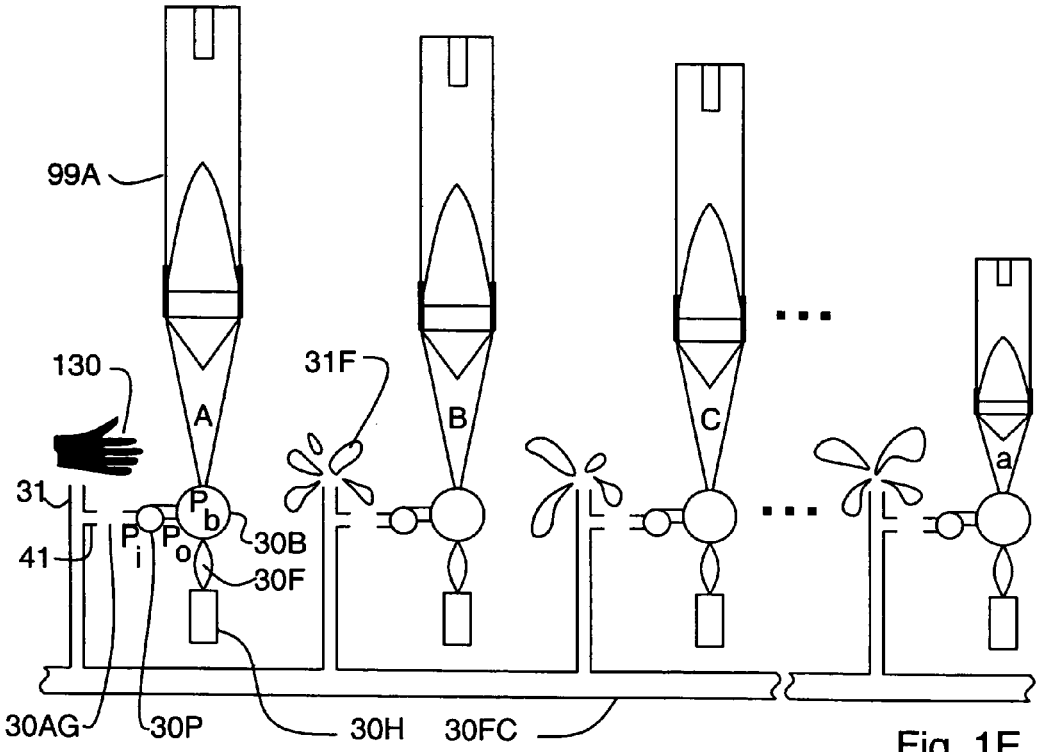
FIG. 1E illustrates a purely acoustic version of the musical instrument that uses water as a user interface medium.

FIG. 1E illustrates an acoustic water-based embodiment of the invention, having eight notes on a diatonic natural minor (aeolean mode) scale: A, B, C, . . . a. Only four of the eight notes are shown: the first three (A, B, and C), and the last note (a). In this usage, fluid chest 30FC carries water to water jets, from which emerge water 31F except jet 31, when and where flow is blocked by hand 130. Alternatively, flow may be partially restricted by hand 130, to vary the amount of water squirting out through side discharge 41.

Each side discharge 41 directs water at the inlet of a pump 30P. The side discharge 41 is not sealed directly to the inlet of pump 30P, but, rather, there is an air gap, 30AG between the side discharge 41 and the inlet of a pump 30P. Pump 30P is a pump that can run wet or dry. When water is squirted into its inlet, it pumps the water into a steam boiler 30B. For each note, there is a miniature steam boiler 30B, to supply steam to a sound making device such as device 99A. In this example there are 8 boilers, 4 of which are shown in the drawing. A suitable device 99A would be a pipe from a steam calliope, steam organ, steam whistle, or the like. Each of the 8 boilers, such as boiler 30B, are heated by flame 30F from heat source 30H.

The purpose of pump 30P is to overcome the pressure $P_b$ in the boiler. Thus pump outlet pressure $P_o$ should be greater than pressure $P_b$ in the boiler. However, if pump inlet pressure $P_i$ can be made higher than pressure $P_b$ in the boiler, then pump 30P and air gap 30AG are not necessary in this case, water is squirted directly into the boiler. A typical scenario might be to use calliope pipes that take very low pressure, such as 2 inches (approx. 51 mm) of water column, so that the water squirted out of side discharge 41 has sufficient pressure to sustain a note without the need for pump 30P and air gap 30AG.

Otherwise if the boiler pressure is too high, notes cannot be sustained. A one-way valve can be used, instead of the pump and air gap, if notes of short duration are acceptable.

When a jet such as jet 31 is blocked or partially blocked, water is squirted into a pump such as pump 30P to feed boiler 30B to sound device 99A. The water is convereted into steam in the process, resulting in a nice visual effect, as well as the sound.

If desired, a hybrid acoustic/electronic instrument can be made in which steam is produced, while at the same time triggering a note. This may be done with electronic ultrasonic atomizers in place of boiler 30B, flame 30F, and heat source 30H. Pump 30P can also be eliminated, so that the water is squirted directly onto the atomizer.

Steam atomizers can also be used as sensors. For example, notes can be triggered on the presence of steam, by way of optical, conductivity, or other sensors.

Some atomizers come on automatically when squirted with water, in which case the electrical load change can trigger notes. For example the atomizers can be plugged into a special intelligent power bar that senses electrical draw from each outlet, and activates notes when there is electrical draw. Thus notes get sounded electronically when steam is generated or when steam is called for.

Since many atomizers are ultrasonic, the ultrasonic waves can also be used to directly sense the position of hand 130, thus eliminating a need for jet 31 and side discharge 41. Instead, the hand position in the water is determined by the ultrasonic wave, using the ultrasonic disk in the atomizer as both a sender and receiver of sonar. Sonar devices may also be installed in the jets 31 to make a hybrid electronic/acoustic instrument, and various sensory combinations.

Alternatively, RADAR (Radio Direction and Ranging) or LiDAR (Light Direction and Ranging) or some other form of energy may be transmitted and its reflection measured, in order to determine hand position. In a very simple embodiment of the invention, a photocell or light sensor may be installed in each of a plurality of holes of a pipe, so that the system measures restriction of the flow of light. Such a restrictometer measures how much light is restricted, independent of the flow of fluid. Thus the presence of the fluid-in-motion (e.g. air or water jets) can be there just for tacticle feedback, while the actual sensing is done with photocells. Satisfactory photocells are photoresistors such as Cadminum Sulphide (CdS) cells. The resistance of the cell decreases as the light to the cell increases. Therefore, a sensor senses the increase in resistance as the cell is blocked, and increases the volume of (or abruptly turns on) the note corresponding to the hole corresponding to a particular photocell. Some embodiments of the invention can use ambient light and the attenuation thereof, in which case a dummy photocell in a wheatstone bridge helps to mitigate the adverse effects of changes in ambient light levels.

Alternatively, an L.E.D. (Light Emitting Diode) and a photoreceptor (such as a photodiode or phototransistor) may be used, to measure reflected energy from a user's hands or fingers, or the like, placed over each of the holes. In this case, the fluid may also be used just for tactile feedback, independent (if desired) of the restrictometry, where said restrictometry is a measure of the degree of active restriction (restriction of a source of light from within). Typically in this autorestrictometric (self-restrictometric) embodiment the light is infrared. Typically, in this embodiment, the outgoing light is modulated, so that some kind of encoding (whether by a simple lock-in amplifier, or more sophisticated coding) allows the system to be some what immune to changes in ambient light. Therefore, in much the same way that automatic flush urinals and automatic hand wash faucets ignore ambient light, the musical instrument of the invention can also ignore or be less affected by ambient light.

Figure 1F:
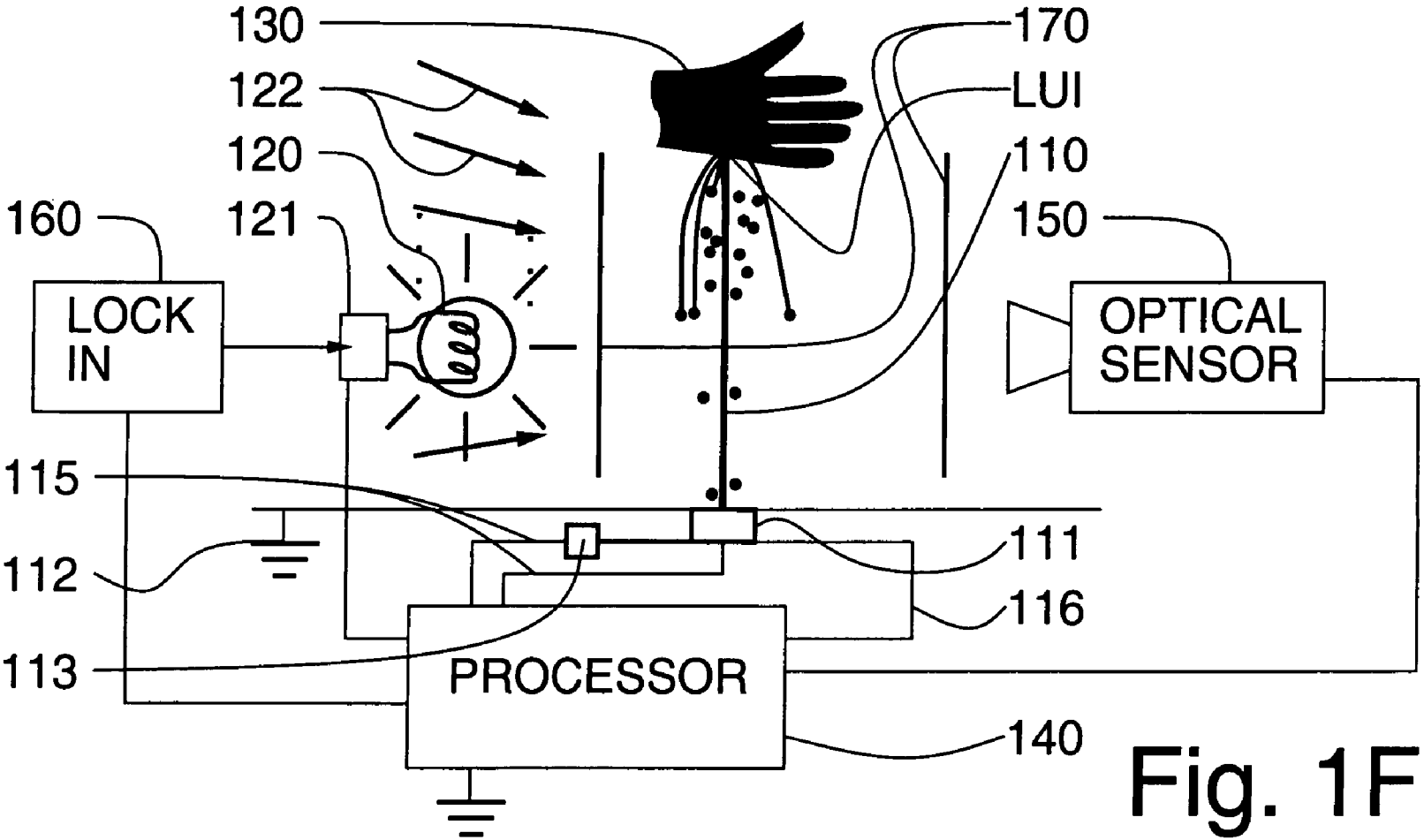
FIG. 1F illustrates the principle and components of a single-jet embodiment of the invention.

FIG. 1F is a diagram depicting a fluid jet 110 that sprays water in the air from a ground nozzle 111, flush with ground level and at ground potential, electrically connected by ground 112. A satisfactory ground nozzle is a laminar flow nozzle, such as the nozzles made by WET Designs, since the laminar flow has desirable optical properties, for the recognition of the height of jet 110 by a computer vision system. A system for dispensing and animating the water in packets, such as by way of nozzles often used for decorative fountains (like the fountains in front of the Brooklyn Museum that provide dancing jets of water) is desirable in some embodiments of the invention, so that the water can be finely controlled as part of a user-feedback loop, embodied in processor 140, through flow controller 113. Water dispensers known by the trade name "Jumping Jacks" may also be used.

Splash, spray, and jets of water tend to look very beautifully intense when backlit, such as when one looks at fountains when the sunlight is behind them, or when people splash into a pool with the sun behind the droplets of water. This is because the droplets behave like a lens, though poorly, in terms of optical quality, but good enough to concentrate the sun's rays over a range of angles where at least some of the water caustics (loci of points of what would be infinite brightness in simple theory) are visible slightly off-axis.

A bather blocks a portion of the jet 110, for example, with their hand 130, to prevent the jet from going beyond a certain height. Generally when a bather inserts his or her hand 130 into the jet, the water will hit the hand and crash back down mostly, with various droplets sprayed in the area.

A light source 120 serves to backlight the jet 110 with respect to an optical sensor 150, in order to measure the height of water column of jet 110 by way of processor 140. A baffle 170, either as part of light source 120, sensor 150, or a combination of both, or as separate elements, keeps light from shining from light source 120 into sensor 150 even though both are opposite jet 110, except, of course when and where jet 110 is spraying. This arrangement causes there to be almost complete darkness where there is no water, but almost complete whiteness where there is water. Thus the user's hand 130 will appear in silhouette, as a black outline, along with the user's body, and other objects, but the water jet, and all the droplets of water, will be bright white.

A satisfactory optical sensor 150 is an ordinary video camera, wherein processor 140 may be equipped with a frame grabber so that it can analyze the image of the backlit jet 110 and determine the highest bright spot, which corresponds approximately to the highest that the jet was allowed to go by hand 130.

A good kind of light source 120 is an aircraft landing light, or a PAR 36 or PAR 38 pinspot light, as are commonly used at rock concerts, and in theatrical lighting, to create dramatic strongly collimated light that emulates natural sunlight. In addition to providing an ideal light source for the computer vision system of sensor 150 and processor 140, such light creates a very pleasant "summertime" atmosphere that makes the invention comfortable to use in cooler weather, since the strongly collimated light has both an actual (concentration of heat rays) as well as psychological warming effect. Thus playing in the water jet is warm, and the living is easy, in the sense that a bather can feel nice and warm while playing.

In case there is actual sunlight that might illuminate background objects such as glare off windows in the background that could falsely activate the optical sensor 150, a lock-in amplifier may be used in the system to improve signal to noise ratio, or some other form of light modulation may be used, with controller 121. A satisfactory controller 121 is a bidirectional triode thyristor based control, such as by way of a triac-based light dimmer, although IGBT-based light controllers that can generate more arbitrary waveforms are more desirable. An insulated gate bipolar transistor (IGBT) is preferable as it combines the high current density characteristic of a bipolar junction transistor with the fast response and better output characteristic typical of an insulated gate field effect transistor (e.g. MOSFET). The ability to generate arbitrary waveforms is useful for signaling and modulation schemes.

In general, some form of light modulation, lock-in 160, puts a message signal onto the light, so that fluctuations in the light bear the message, whether it be a sinusoidal variation of light output that rides on a DC (Direct Current or other average) offset, or some other encoding. Ideally an adaptive encoding is used, as necessary, to modulate the light for good signal to noise ratio.

In the interest of modulation, a tungsten aircraft landing light, or the like, may be less desirable than a light source 122 that is based on Light Emitting Diodes (LEDs), especially since LEDs can be arranged in a linear array parallel to the jet 110, and also can be toed in to all point at optical sensor 150. This results in more efficient use of light as well as a better exploitation of the lenslike properties of the water jet 110. In so far as the jet 110 behaves optically similar to a glass rod, its properties may be best exploited with the arrangement of sources 122, as high brightness LEDs that have very narrow field of illumination (i.e. that concentrate most of their optical energy along a narrow axis) arranged to point as depicted by the arrows. Thus the lights furthest to the ceiling point downward, whereas the lights near the floor point up. This way, each section of jet 110 is perfectly backlit.

In typical usage, a bather may interact by pressing down a water jet 110, or by swinging the hand at the jet 110, or by taking a swipe at it, or even pulling a piece out of the middle of the jet 110. This action is sensed, and results in some outcome, typically given to the user by way of some feedback. The bather's interaction will typically select from a discrete alphabet of symbols, much like a "QWERTY". keyboard on a computer, or an "ABCDEFGABCDEFGABC . . . " keyboard of a piano. Additionally, this alphabet may be a multidimensional alphabet in the sense that each symbol may have meta information in it. On a computer keyboard, when we type the letter "A" there is no emotion carried with how hard and angry we hit the "A" or when. A piano carries more meta information with the key. Accordingly, the invention allows even more meta information than with the piano keyboard. In addition to velocity, force, displacement, and timing profile, the multidimensional alphabet selector of processor 140 can measure subtle nuances of the way in which the letter "A" is plucked from the column of water jet 110.

Once a symbol is chosen from the plurality of possible symbols, this symbol may then take action in feedback to the very input device that the symbol was plucked from. Unlike a computer keyboard, or even a piano keyboard, there is a programmable closed loop feedback system that modulates the very input medium.

Consider, for example, a simple task of adjusting water flow using the new input device. For example, the water jet 110 can simulate quantized states of height, and remember height, where the user can adjust the height of the jet, by hand. If the user wants the jet to run low, the user simply pushes the water jet down, and it stays down when the user walks away. If the user wants the jet to come back up, he or she walks over to it again, and grabs the jet 110 and pulls it up. In this application, the jet sprays up until it encounters the user's hand, and then stops. The system can detect the user's hand in a variety of ways, either directly by computer vision, or more preferably, by a better closed-loop process in which:

1. water jet 110 height is initialized to zero by setting control outputs from processor 140 to control inputs to a combination of nozzle 111 and controller 113 such that the flow is zero or sufficiently low;

2. jet 110 height is incremented by applying ever increasing amounts of flow, by appropriate adjusting of outputs from processor 140 to control inputs to a combination of nozzle 111 and controller 113;

3. the transfer function between a jet control input signal 115 (consisting of control outputs from processor 140 to control inputs to a combination of nozzle 111 and controller 113) and the height of the jet is adaptively modeled (having been determined previously but with adaptation to varying wind, varying water characteristics, and the like);

4. a change in the transfer function characteristics is continuously checked for;

5. if increments to jet control input signal 115 do not result in sufficient increase to the height of jet 110, then it is assumed that the jet is blocked, such as by hand 130;

6. the height at which the jet is blocked to is continuously monitored, while continuously checking for unblocking of the jet;

7. when the jet is unblocked, it is controlled actively to remain at the height at which it was last unblocked. This controlling is done in a closed loop fashion, by maintaining the height with jet control input signal 115 being adjusted to keep the jet at that height despite drift due to changes in water pressure, wind, and the like.

In a preferred embodiment, whenever no bather is detected (i.e. no blockage by hand 130 is detected) the jet 110 rises and falls in a sinusoidally periodic fashion in order appear playful and enticing. In particular, many fountains have rising and falling jets which are found to be quite pleasing. For example, the architectural and artistic focal point of Canada's cultural and civic epicenter (known as "Times Square North") in Toronto's Dundas Square is Dan Euser's sculpture which consists of 600 ground nozzles (arranged in 20 grilles with 30 nozzles each) that spray water up in a rising and falling way to mimic the waves on a beach, or the pounding surf of the ocean. (In http://wearcam.org/dundas-square/ there is an explanation of Dundas Square's existing waterplay nozzle jet sequencer.)

This provides a soothing sound that masks traffic, while inviting people to play in the water.

Thus the present invention can be used in similar kinds of places, to create the same kind of rising and falling surf, but while also being responsive to input from users. The present invention allows people to sculpt the water, and have full playing in the fountains while shaping the water flow through play.

In preferred embodiments, the rise and fall continues but with reduced amplitude, when jet 110 is blocked, and the continued oscillation of height of jet 110 is in the vicinity of the blockage, so that the rise and fall can be used to advantage as a way to more accurately measure the response effect of the blockage.

In an alternative simpler embodiment, the jet 110 can simply be powered more than where blocked, as previously known by the transfer function between signal 115 and height. Thus it can simply then be known that blockage has occurred when the height is less than it should be for a given signal 115.

In either the preferred or simplified embodiment, the signal 115 is preferably dynamically varied against the blockage of hand 130, to provide a time-varying tactile feedback signal to the user. This can be used to send back a "buzz" that the user feels upon the hand, much like the vibration of a silent pocket pager or cellular telephone vibrator.

This vibration can vary in pitch, amplitude, waveshape, and chirpiness, etc., as a way of providing user feedback as a variety of user felt symbols, either from a discrete "dictionary" or as a more continuously felt form of water expression.

Additionally, since the ground is wet, and since water that has been treated with salts, chlorine, bromine, or the like, is very conductive, a return path through the user may also be detected along with other additional optical properties, such as a change in the color of the jet 110. Especially if the jet 110 is laminar, it behaves like a fiber optic information conduit, and the flesh color of the hand is visible inside the jet, as an additional measurement signal 116. Thus processor 140 has various ways of detecting and measuring the presence, position, orientation, and the like, of hand 130.

Additionally processor 140 measures the way in which water is swept away by hand 130, so, for example, smashing through the jet 110 to push water to the north can result in different action than pushing east, west, or south. Pushing the water up and to the north can take different action than pushing it down toward the ground and to the north. Thus the direction of entry of the hand, as well as the direction that the water actually splashes, can affect the Wet User Interface (WUI), Fluid User Interface (FUI), more specifically, typically a Liquid User Interface, LUI. In large installations like public fountains that are also important architectural landmarks, it may be desirable to have multiple such jets 110, each differently colored by lights inside nozzles 111. Thus a whole array of beautiful dancing fountains can be set forth that can be choreographed by automation that is adjustable by people playing in the fountains. Each jet can also be a separate symbol area for selecting from a discrete alphabet of symbols out of each jet, or out of the ensemble, or any combination thereof.

In this case, light source 120 may be a source that tracks and follows a bather, to backlight whichever spray jet 110 the bather decides to activate next. Followspot technology in which a spotlight follows a stage performer as he or she moves around, is well known in the art. Thus an automated followspot may be used as both a vision aid for the optical sensor 150, as well as to keep the bather warm, and illuminated, as might be desirable in an interactive art installation. Alternatively if it is desired for the vision light to be invisible, an infrared aircraft landing light, or the like, can be used. A satisfactory such light source 120 is a dichroic PAR 56 (Parabolic Aluminized Reflector size 56) infrared heat lamp or similar light as often used in security applications. This will still serve to keep the bather warm, and to provide illumination for the vision system including optical sensor sensor 150. Thus the bather can freely move around in a large waterplay area and interact with various jets.

For example, all six hundred of the jets in Dan Euser's masterpiece at Dundas Square could, in principle, be made to rise and fall in response to one person inserting their finger into one of the jets. Thus simply touching one small spray of water would result in a chorus of thunder from the other 599 nozzles. Children and adults alike would thus take a moment from their walk through the Square to stop and touch the water, and create dynamic art. This touch to the water could also affect momemtarily the billboards and giant pixelboard displays. While momentarily interrupting the advertising for art's sake, lost revenue could be made up for by the fact that more people would be looking up at the pixelboards because they would be truly interactive extensions of the water spray as their input. For example, pressing down on the nozzle jets could cycle through various ads, making the nozzles function like buttons on a TeleVision remote control. This would create a public interactive waterplay art installation in which the water jets become input devices, much like the keyboards and pointing devices of computers. An omnidirectional jet could also spray in various directions until blocked, and thus direction could replace heigt, or could be another parameter in addition to height, of jet 110. This can be used as a pointing device in place of a computer mouse or trackpoint, and can also be more expressive by including the two dimensions of cursor position in addition to other dimensions like the three dimensional space plus the fourth dimension of orientation, and more (including multidimensional hand position, orientation, etc., not to mention also the wonderful tactile feedback that the immersive nature of water spray provides.

Fountains could also be internetworked, i.e. fountains that are too big to safely play in (such as the fountains in front of the Bellagio Hotel in Las Vegas) could be controlled by a smaller waterplay fountain.

In this way a small child could choreograph the Bellagio fountains by playing in a smaller fountain.

Such a large and expansive show presented from an individual could function much like a karaoke machine, in the manner in which an individual person of ordinary talent could "give" an excellent and dramatic show or performance. To the extent that karaoke is defined as a "method for the intoxicated to embarrass themselves" (Wikipedia.org online encyclopedia) playing in the fountains can further the fear of singing in public with the added fear of being seen in a bathing suit (or underwear) in public. In this sense, interactive waterplay performance spaces could be installed in "watering holes" and other drinking establishments like restaurants, lounges, hotels, and bars.

Figure 1G:
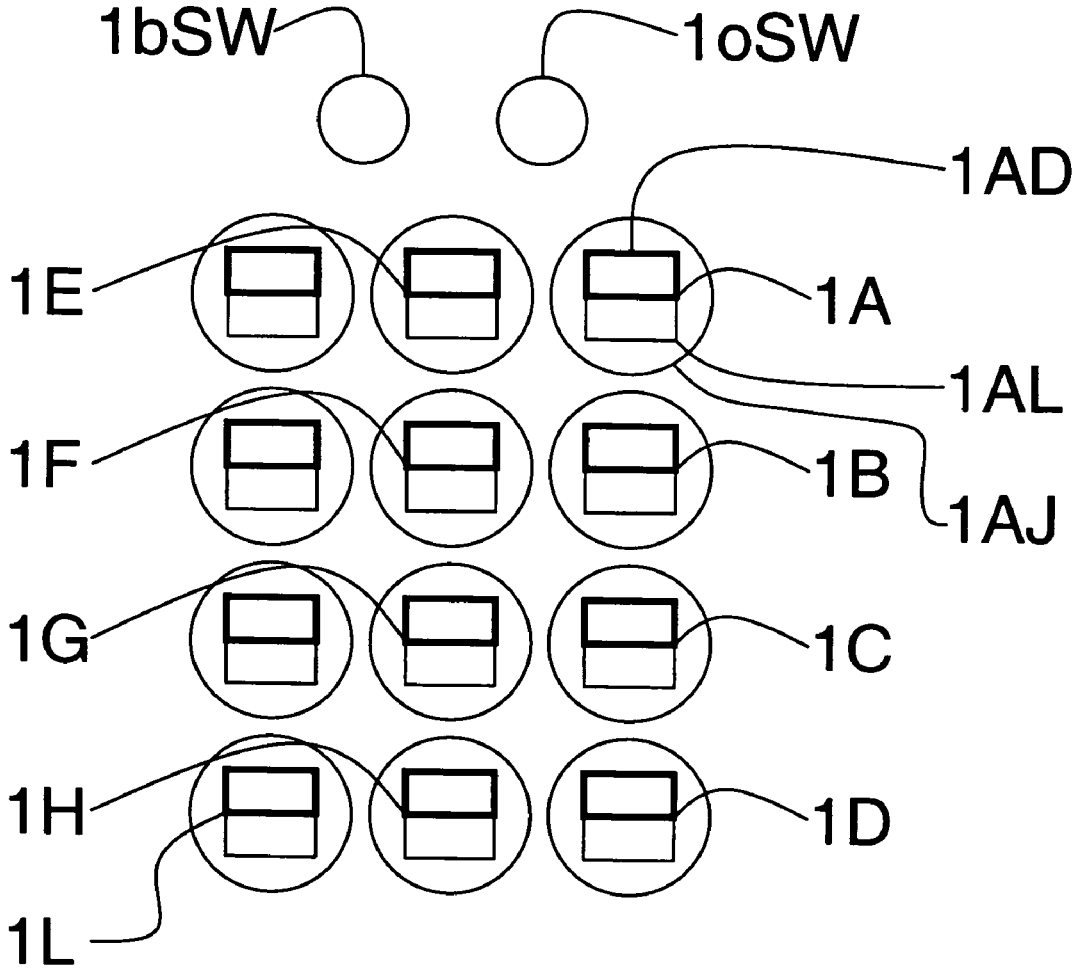
FIG. 1G illustrates an arrangement of jets suitable as an input device for a wearable computer, in which jets of compressed air form the tactile feedback mechanism, whereas the restrictometers measure optical restriction and operate entirely separate from the fluid flow.

FIG. 1G illustrates an arrangement of 12 jets, suitable as an input device for a wearable computer. The jets, beginning from jet 1AJ in the upper right corner, are arranged in three columns of four jets in each column. Inside this air jet hole there is a photo detector, 1AD, and a photo light source 1AL. Light source 1AL and detector 1AD, together with other circuits and processing (said circuits and processing well known in the art of automatic flush toilets, automatic faucets, etc.) comprise restrictometer 1A. A satisfactory restrictometer may be made from a single 4-wire package that contains a phototransistor and a Light Emitting Diode (L.E.D.). Other restrictometers; shown as 1A, 1B, 1C, and 1D, form the first column depicted at the right. The next column is comprised of four more restrictometers 1E, 1F, 1G, and 1H. These eight restrictometers are supplied to a wearable computer that synthesizes the notes low-A; B, C, D, E, F, G, and high-a, in response to restriction of light. The circuits are arranged so that sounding of the notes begins when a finger is within one half to one quarter of an inch (one centimeter or so) of any of the restrictometers 1A to 1H. The eight restrictometers 1A to 1H are connected and programmed to sound the corresponding notes of the natural minor scale, from low-A to high-a, so that simple melodies like Summertime, The Ants Go Marching, The Cat Came Back, America I Love you So, Napoletana Tarantella Dance, etc., can be played, by successively blocking the light leaving sources such as 1AL, so that the light is blocked and reflected back to detectors such as 1AD.

FIG. 1G shows the front of the "keypad" facing the user, but in actual use, a wriststrap is provided and the keypad faces away, with the fingers curved around, in the same way that a person would hold a Twiddler. In fact, the first eight notes A-H are the same letters of the Twiddler product that is manufactured by Handykey Corporation. The last column gives the notes high-b, high-c, high-d, and high-e. Each row is separated from the previous or next row by an interval of a perfect fifth, so, for example, going across from restrictometer 1A, to restrictometer 1E, moves up a perfect fifth. Air holes for jets such as jet 1AJ, allow puffs of air that are dynamically controlled as tactile feedback. In simpler embodiments, a steady stream of air will often suffice as the feedback mechanism. Thumb switches 1bSW and 1oSW reduce the output frequency by one semitone, and one octave, respectively. Thus, for example, to play a b-flat, a user restricts the flow (of escaping light) from restrictometer 1B, while simultaneously holding down the thumb switch 1bSW. The other thumb switch 1oSW serves to extend the range of the instrument, so that it covers almost three octaves.

Some simple chords can also be played by restricting multiple jets at the same time. For example, simultaneous restriction of restrictometers 1A, 1C, and 1E, results in an a-minor chord, whereas simultaneous restriction of restrictometers 1C, 1E, and 1G results in a c-major chord.

Figure 1H:
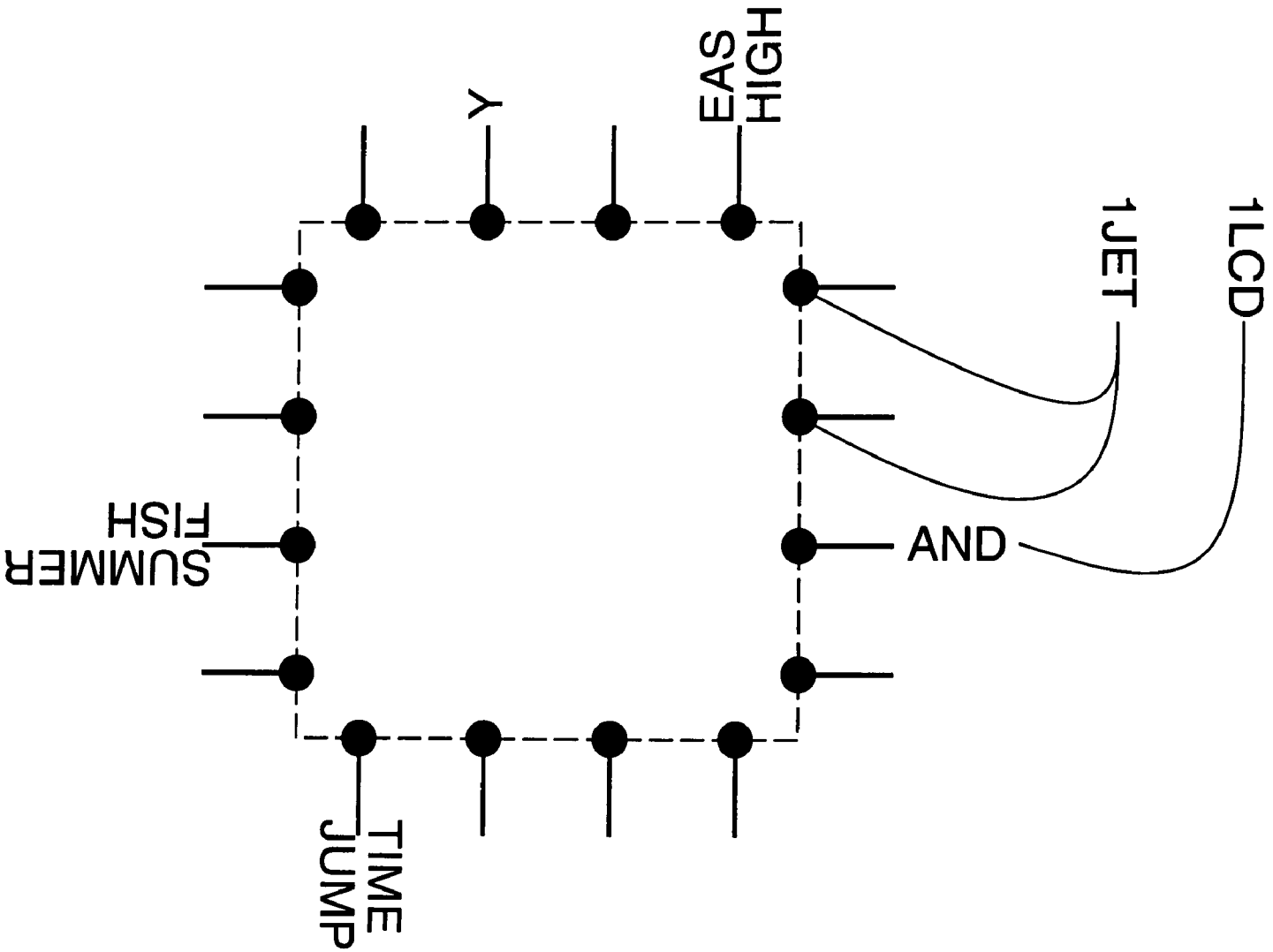
FIG. 1H illustrates an arrangement of jets suitable as an input to a game that teaches children to sing at a constant tempo.

The general embodiment depicted in FIG. 1G can also work in the absence of the tactility of the fluid. More generally, many embodiments of the invention include some form of tactualizer, in conjunction with restrictometers. In the absence of fluid, the tactualizer is the holes themselves which can be felt, when used with the restrictometers, to create a flutelike experience for the user. FIG. 1H illustrates an arrangement of jets 1JET suitable as an input to a game that teaches children to sing at a constant tempo, by way of Liquid Crystal Displays 1LCD, as the output device of a computer system with the jets as input. The game pad can be incorporated into splash pads, spraygrounds, public pools, and the like. The jets are arranged in a square pattern, on a rubberized surface, so that as a user stomps on top of each jet in succession, a song, such as Gershwin's 1935 lullaby, "Summertime", is played. Two or more players can also stomp around the square, going counter-clockwise, as they play. For example, a player stomps on the word "SUMMER" with his or her left foot, and then the next jet with the right foot, and then the word "TIME" with the left foot, and so-on, eventually walking around to the word "AND" which is hit with the left foot, and later the word "EASY" also hit with the left foot. The lullaby plays through a speaker mounted in the center of the pad, and if the player stomps at the right tempo, points are awarded, and the music plays louder and stronger. If the tempo is a little off, the music adjusts to match the tempo of the user, but the music turns down in volume to indicate the timing errors. Additionally, the Liquid Crystal Displays LLCD can dynamically prompt the player through the song, and offer help in response to errors in temp. The line of the first verse of the song then replaces "SUMMER" with "FISH" (the lyrics of the second line), etc. Finally, after the first verse, the words "FISH", "HIGH", etc., on the Liquid Crystal Displays 1LCD, change to "THEN", "SKY", etc.

Figure 2:
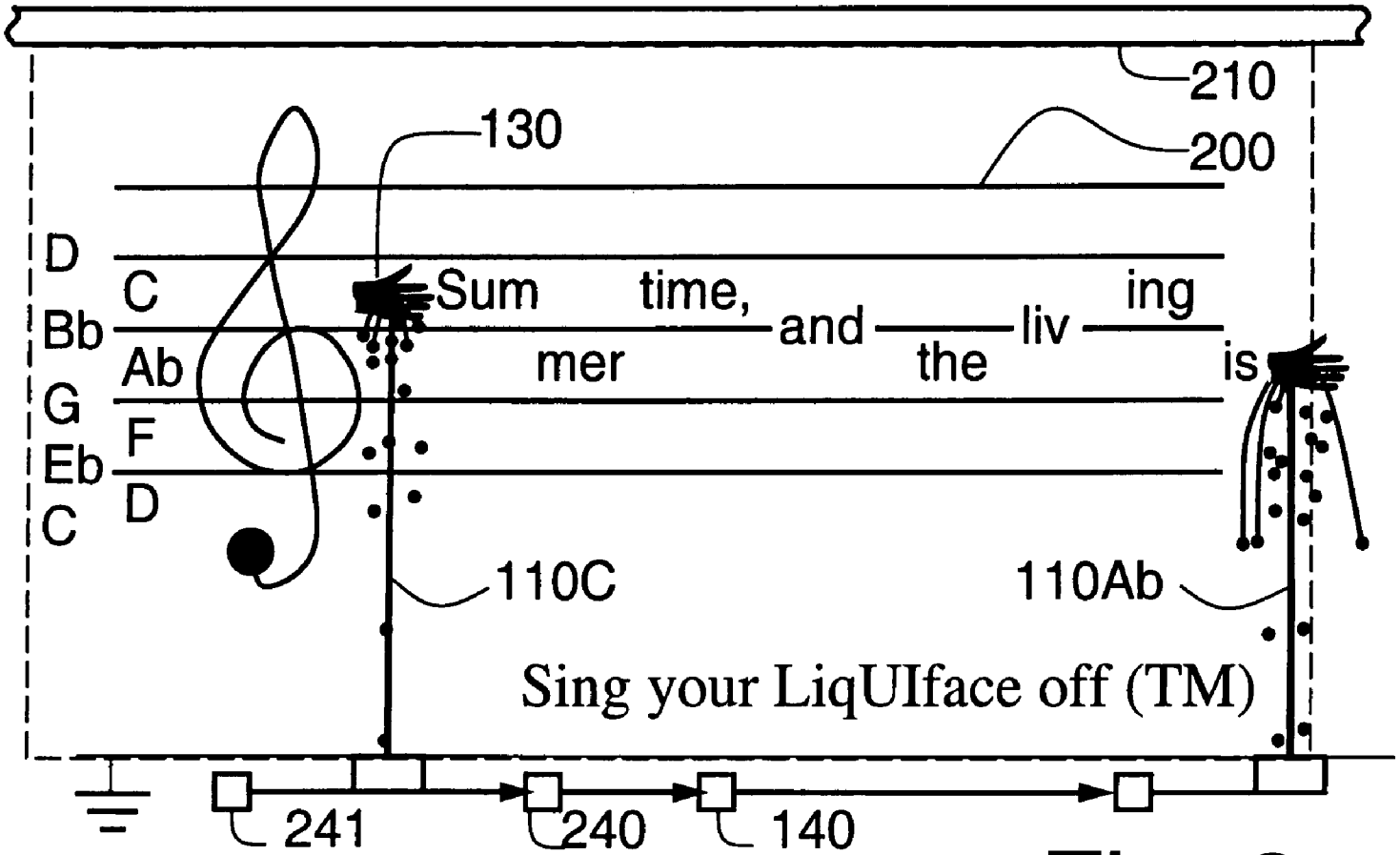
FIG. 2 illustrates how the single-jet embodiment of the invention may be used to convey a very expressive form of freely flowing, continuous input data with fluidity.

FIG. 2 is a diagram depicting a splash screen or splash page 200, that consists of imagery projected onto a sheet of water that is sprayed from a flat nozzle 210. Here a sheet of music is projected and thus presented to the user, as streaming media, in addition to or instead of jets 110. As an addition to jets 110, splash page 200 may fall behind jets 110, as a wet (and thus immersive) projection surface that the user can read, look at, or choose to ignore (and even "bump" into, walk through, or stand in). The user can refer to the splash page 200 from time to time in order to help remember the words and notes of a song, such as the 1935 lullaby from Porgy and Bess (Gershwin, "Summertime"). The notes in the lullaby are bounded from C to C, since the user has selected the key of C minor to match is or her vocal range. This selection has been made with hand 130 to block the height of jet 110C to a height that corresponds with the highest C note, the first note of the song. Thus blocking the water spray forms a liquid user interface into the streaming media.

In response to that selection, the processor 140 has caused the words of the song to display in a manner appropriate for a C minor key, so that the user can sing along with the song, displayed in a karaoke fashion. Additionally, the notes themselves are displayed in a similar way, so that the user can play the notes while singing. The notes are played using the Liquid User Interface, LUI, formed by water and the interaction with the water, i.e. a note is sounded based on when, where, and how forcefully the user touches the water. The nature of the water's path once it is deflected, also affects the way the sound occurs. Not only can the user "pitch bend" notes (such as near the end of the lullaby, on the word "don't" in "hush little baby, DO-N'T you cry" which bends down a minor second) but the user can also affect the nature of the sound by hand position.

In the preferred embodiment, the hand position is sensed by the direction the water sprays off the hand 130, such that the sense of hand control is very intuitive because it is then consistent with the overall philosophy of the Liquid User Interface, LUI.

For example, if the user tips the hand 130 so it is angled up and to the right, the water jet 110C will splash against the hand and water will splash off to the right. Thus, in addition to sensing how high the jet went before it got blocked by hand 130, this direction of splash will be sensed by optical sensor 150, with processor 140.

To play the song, the user pushes the jet down to get lower notes, and lets up on it to get higher notes. The jet 110Ab is shown pushed down to affect a change in pitch downwards by a minor third from where it is in 110C. This change also operates as a closed-loop feedback system, so that pressing down on the jet 110C to jet 110Ab results in a feeling like a fret or similar disturbance at B-flat, Bb, along the way.

More generally, the present invention includes various forms of tactile feedback, so that, for example, pushing down on jet 110 results in a tactile sensation that is, in this example, achieved as follows, operating in processor 140:

- sense height position of hand 130 along the height of jet 110 by way of height sensor 240 which may comprise optical sensor 150 in conjunction with processor 140, or which may be a separate height sensor;
- compare height with an indexed list of virtual water fret positions;
- when one of these water fret positions is reached, provide extra stimulation of the hand 130 with the water, through stimulator 241, for as long as hand 130 is within a certain tolerance of the height position;
- repeat.

The above describes a rectangular tolerance window, but in actual preferred embodiments, a Bartlett, Hanning, or Hamming window is used so that the virtual fret has rounded edges rather than square edges. Additionally, the water always provides some sensation, but the extra "buzz" of riding right on top of a fret, is created by modulating the water spray in a fine burst of rapidly changing levels, so that the user can feel each note, as if a softly quantized instrument like a guitar were being played on real frets that do such quantization. This creates a Theremin-like experience but without the lack of tactile feedback. An alternative or an additional form of feedback may include small electrical impulses in the water, changes in water color (as by lighting, etc.) changes in water temperature (as by, for example, alternating hot and cold jets of various duty cycles), Additionally, one water source may provide feedback for actions done on a different water source, for example, splash page 200 may be an output device for input from jet 110.

The sheet of music is projected onto the sheet of water which may also be a touch sheet, that functions like a touch screen, so that as the user touches the sheet, the coordinates of the place where the sheet is touched are sensed. This can work in addition to jet 110, or it can completely replace jet 110. When not using jet 110, the splash page 200 becomes the primary user interface.

There may also be a switching back and forth between the two modes of user interface, e.g. a novice user who wants the splash page 200 to stay, may interact with it, whereas by an appropriate gesture of pushing away at it with both hands, it goes away. Splash page sensors are present to detect when it is pushed away, either by both hands or the whole body of the user. Thus the splash page can be just an introduction, or for instructions, that goes away when the user is finished with it.

Figure 3:
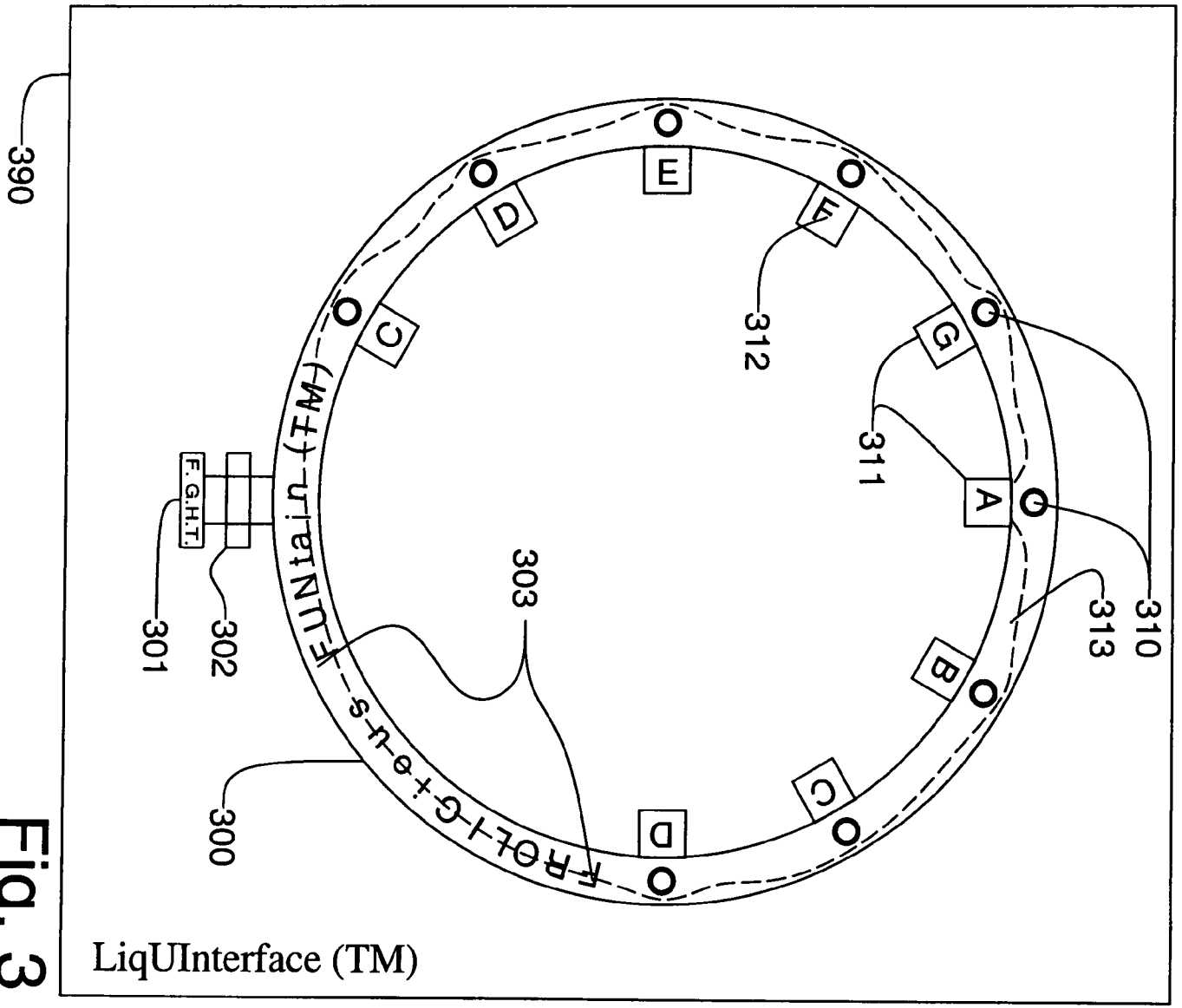
FIG. 3 illustrates a multi-jet embodiment of the invention.

FIG. 3 is a diagram depicting a multi-jet wet-user-interface, Nine jets 310 spray water upward, tilted slightly toward the middle. A ring manifold 300, having a diameter, in the preferred embodiments, that ranges from 20 inches (approximately 51 cm) to 2 meters, has a Female Garden Hose Thread (GHT) connector 301 on a "T" fitting that supplies it with water in both directions. Each nozzle jet 310 is supplied from both directions with water. The entire manifold 300 and jets 310 may be supplied by fresh water from a garden hose, with runoff going to irrigation, such as when playing in a garden, or it may be supplied by water from a batter operated pump such as a bilge pump used in marine applications. Capacities of bilge pumps are usually specified in gallons per hour; preferred embodiments of the invention work well with bilge pumps in the capacity range of 500 GPH to 2000 GPH, with higher capacities being sometimes preferable for dramatic show, of the spray of the invention, but not usually necessary for good functioning. In particular, the preferred capacity is around 1000 GPH.

In a preferred embodiment of small size (e.g. 20 inches, or approx. 51 cm diameter), the pipe size for the curved pipes of manifold 300 is ½ inch plumbing which is equivalent to ⅝ inch refrigeration (plumbing is specified as inside diameter but the refrigeration industry specifies by outside diameter). This size is suitable for being worn over the right shoulder, so that the high notes are to the right, and near the top, and the low notes are to the left and near the bottom, in front of the body of the user.

Jets 310 may be made by cutting an appropriately curved pipe into sections and then rejoining them with reducing "T" fittings. Suitable reducing "T" fittings are ½ inch through to ¼ inch (⅝ inch through to ⅜ inch in refrigeration sizing). A piece of size ⅜ plastic toilet or sink hookup sleeve fits nicely into each opening in the reducing "T", with a good friction fit. Thus a module 311 may be built around the plastic sleeve, and inserted into each hole as needed. In this way, an entire module can be quickly replaced in the field. Module 311 is a flow sensor, and may also perform the role of an output device, such as flow control, or other stimulus to the user. At the very least, module 311 should measure the amount of flow, and thus facilitate a continuous fluid user interface. In this particular embodiment, each jet is associated with a different note. Each note may be thought of as a symbol selected from a discrete alphabet of symbols, and each jet may be considered therefore as a symbol area, or a region around a symbol area, in which the symbol is selected by having the user enter this area. Movement between symbol areas results in the generation of an ordered list of symbols that are also annotated. The annotated ordered list uses annotation to record time of entry and exit to and from the area, and various attributes of how the entry and exit was made.

Each note sounds in amplitude that depends on how far down the jet for that note is pressed. For example, if pressing down the "C" jet, the C note will sound and the sound will grow louder as the jet is pressed further down. To play a C-Major cord, the C, E, and G jets are all three blocked together. To play a C note with a C-Major to accompany it, the C jet may be blocked entirely, and the E and G only blocked slightly, or the fingers may hover above the E and G, just lightly in the spray, whereas the finger may reach deeper down into the spray of the C jet.

It is preferable that the notes are activated by displacement rather than velocity, but if velocity is desired, the height value may be differentiated by processor 140. Since it is easier to take reliable derivatives than integrate reliably (due to the presence of baseline drift), the absolute height measurement of each jet is preferable to the velocity information.

The default setting for the instrument is also in displacement, and behaves much like a church organ, which is also easier to sing to than the more percussive and more ephemeral sound of a velocity based (and percussive) instrument like a piano.

The device may function as a direct user interface to a real organ such as a real pipe organ, or it may activate other synthesis devices by way of Musical Instrument Digital Interface (MIDI) output, serial output, wireless control, and the like. Because the manifold 300 is made of copper, it can advantageously shield the system, and thus the fact that copper is a common plumbing material as well as the most common electrical conductor, is advantageous. Internally a loop antenna 313 can still transmit through the copper since magnetic fields can there outwards propagate. Loop antennas, unlike dipole antennas, provide operation despite the copper shielding which serves to keep electrical noise out of the system.

Ordinarily, water from city water pressure mains is at much higher pressure than needed for the instrument. City water pressure is typically two to four atmospheres. One atmosphere is approximately equal to 10.3 meters of head, i.e. approximately equal to the maximum height of head that people enter swimming baths from (e.g. municipal swimming baths that have towers with 10-meter platforms). Thus water pressure is approximately two to four times higher than that experienced while bathing in the most extreme way at a pool (i.e. approximately 50 kilometers an hour impact with water after departing from the 10-meter platform).

To convert from the approximately 20 to 40 meter head, down to the lesser pressures needed for the apparatus, a flow control valve, or pressure regulator may be used.

However, it is preferable to recover that energy and use the energy to power the instrument, realizing the sheer magnitude of this energy that would otherwise go to waste. Thus an energy recovery module 302 may power the instrument.

Novice players may apply adhesive tape labels 312 to each such module, to label the notes. Alternatively liquid crystal displays in the modules may interactively display the notes as well as learning information for lessons, such as highlighting which note to play next.

The water jets may also be output devices either by illumination, color, or by tactile vibration, spray height variation, and the like. In a preferred embodiment, all of the jets are green when they are active idle. To make the instrument easier to play, jets that are not used in a particular song may be shut off. Alternatively, it is preferable to keep all the jets running for aesthetic value, but only illuminate the ones that are part of a given song. For example, to play "Amazing Grace" (words, John Newton 1779, music, Carrell and Clayton, 1831) only six of the jets, namely C, D, F, G, A, and C, are needed. The others may be shut off, or their lights shut off, and a single green light may guide the user through the song, to light up the jet that the user should hit next.

In fact jets could go all the way around the whole circle, even in the back where it is difficult to reach, while only the front jets (easier to reach) would need to be used to play music. Alternatively, the space not used by jets at is used for indicia 303 such as trademark information e.g. as shown "FROLICious FUNtain (™)" along with usage instructions, and the like.

Various modes such as teaching mode, and song to learn, are selected by holding down different combinations of jets at power up time. Unused chord combinations are used as symbols to type messages into a computer to select processor 140 operation. Water typing modes are selectable to type in song names, search parameters, etc., but the water typing is not so bad as mid air typing. It is known that air typing is difficult, like playing air guitar, since there is no feedback but water typing (or water guitar) are made easier by the feedback.

If learn mode is shut off, all jets glow green, until pressed down. As the hand enters the spray, the jet turns yellow, then orange, then red. This is by way of a 3-terminal LED that has red and green elements, and the LED also forms part of the computer vision system that sees the water spray flow diverted.

Thus the LED serves double duty as the light source for the vision system and the illumination. Since the illumination is nice and subtle it need not be visible to others, but can be if desired, by playing in a darkened room. In this way, teach mode can be hidden from others, so that in a liquid interface karaoke setting, only the player can see the prompting.

Alternatively, the apparatus of FIG. 3 can be used as an interface to other equipment, such as a computer. For example, the apparatus may be used by a disc jockey to play pre-recorded music. By spinning the hand around in the circle of water jets, the virtual disk is spun to "scratch" or timewarp or modulate the music. Two such liquid user interface rings, i.e. two manifolds 300 may be used to simulate two turntables, to create a virtual mixing platform. Since many disc jockeys already perform in their boxers or briefs, and since many of the dance clubs have a "foam party" or "beach party" theme (e.g. in many clubs the electrical systems are already wet-safe) the apparatus of the invention may find many applications in such dance and performance oriented spaces.

The circular shape of the apparatus of FIG. 3 is by no means limiting. For example, the apparatus could assume other shapes such as that of the hollow fiberglass frogs commonly found in splash pads and spraygrounds. Alternatively, the apparatus may be built into a swim ring made to float in the water, with the apparatus being entirely self-contained. In this case, the user can put expression into the music by dunking or partially dunking the instrument while playing. The sound can thus be affected by the way the instrument is sloshed around in the water.

A curved portion of pipe may be used, so that the floating and self-contained apparatus can be moved through the water. Other flow sensors can be installed in the instrument to measure how it is being pushed through the water, and thus control the sound or flow of water in accordance with movement through the water. For example, a "mouth" at one end of the instrument can be fitted with a flow sensor to allow there to be an "embouchure metaphor" in which a user pushes the instrument through the water and the water flowing into the mouth is sensed, and this measures quantity controls the flow of water out the jets. In this way, the interface jets rise and fall in response to the amount of water "pushed" into the instrument's mouth. Thus the user can believe, or choose to believe, that the water coming out of the jets is due to the water pushed into the mouth of the instrument. To the extent that a pump may be controlled or modulated in this manner, an embouchure power assist arises in which a user can appear to make the jets rise and fall by moveing the instrument faster or slower through the water. By having these changes in speed of the instrument moving through the water affect the sound, the instrument thus becomes more expressive in a way that is intuitive for a user to understand. This form of expression comes in addition to the move obvious dunking and lifting of the instrument to change volume and tone. Various float and flow sensors can thus be used to make the embouchure of the instrument more richly expressive.

Figure 4:
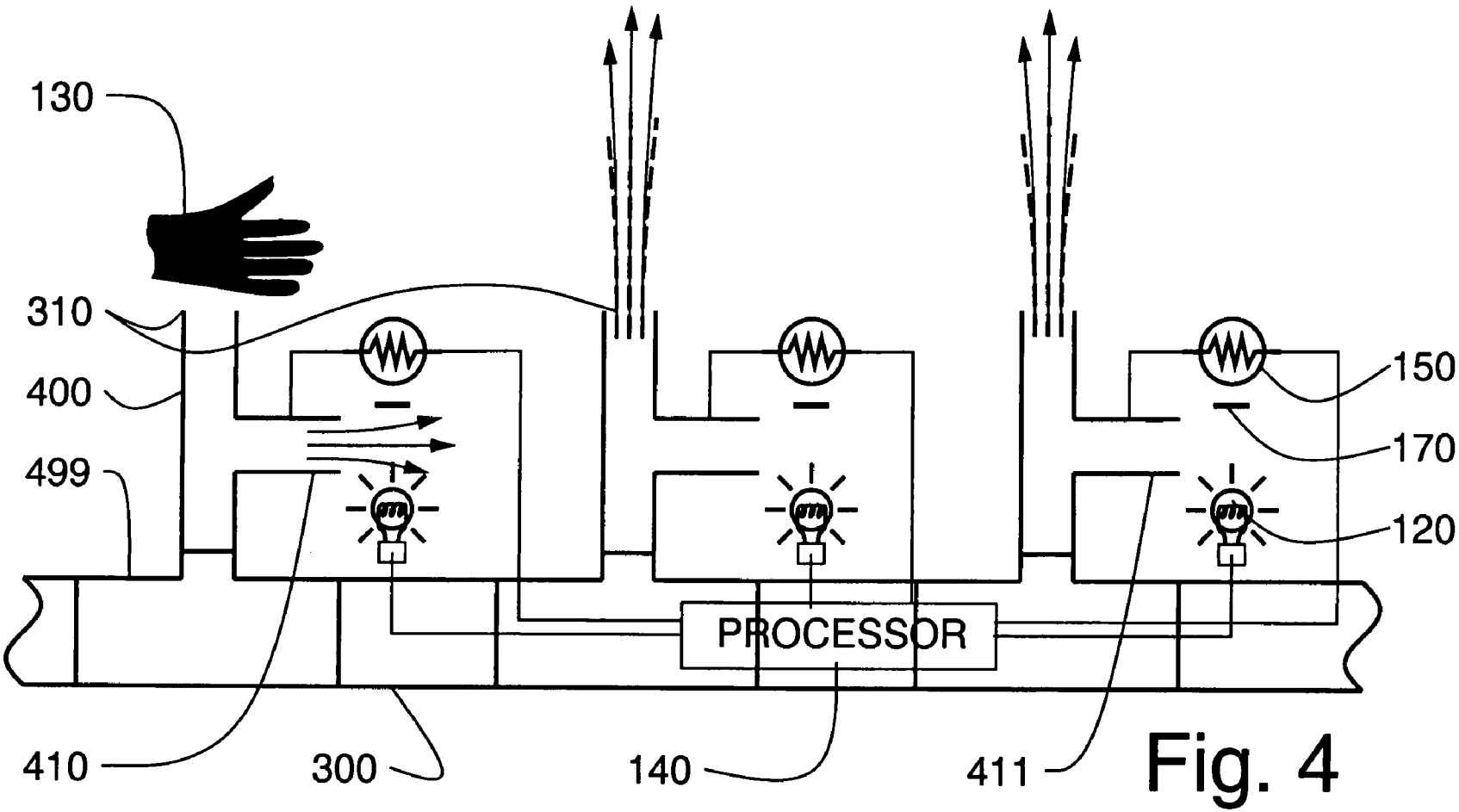
FIG. 4 illustrates the vacuum exclusion principle of multi-jet embodiments that makes flow diversion selectivity possible.

FIG. 4 illustrates the vacuum exclusion principle of the multijet system of FIG. 3. Hand 130 descends to partially block one of jets 310, thus reducing the amount of water that comes out of that jet. The lower the hand 130 descends, the less water can come out of the jet 310 that is under the hand. At least some of the water that would have come out that jet goes out the other jets. Typically blocking one jet results in increased flow out of the other jets. Additionally, each jet has a "T" fitting 400, so that when one jet is blocked water gushes out of the blocked T fitting side discharge 410. Note that "T" fitting 400 is not a reducing "T" fitting, although it may be spliced in by way of an additional reducing "T" fitting 499. Also it is important that jets 310, when not blocked deliberately by the user, do not offer significantly more resistance to water flow than discharges 411.

Interestingly, no water comes out of the other side discharges 411. In fact, the more jets that are blocked, the faster the water gushes out their side discharges and out of the other jets, but at the same time, an even stronger vacuum is created on the unblocked side discharges 411. Thus initially, where all the side discharges are under slight vacuum when none of the jets are blocked, the unblocked side discharges 411 are pulled under even greater vacuum when more flow comes out the unblocked jets, either because other jets are blocked, or when water pressure increases, or the like.

This system works very well, so long as the "T" fittings 400 are small compared with the size of the manifold 300. Various kinds of flow meters, pressure meters, or the like, attached to discharges, will work quite well. In a preferred embodiment, the discharges point to the center, and a flow meter is used, because this allows the bather to get splashed by the discharges, and thus receive tactile feedback. In this way, blocking the jet with the finger or hand results in the body getting splashed by discharge. This often improves the ability of the player to become one with the machine of the instrument. A satisfactory flow meter is a vision system that uses a discharge lens property. Light sources 120 are blocked from shining into optical sensors 150 by baffles 170. Each of the nine discharges has one baffle 170, one light source 120, and one optical sensor 150. In this multijet embodiment, an individual photoresistor is used for each discharge, rather than a single camera. The circular array of nine photocells (photoresistors) may be thought of as a nine pixel camera if desired, from a conceptual point of view. When water flows out through discharge 410, the spray forms a crude but sufficiently effective lens that light rays from source 120 reach sensor 150. Photocells of sensor 150 should point downward and the lights 120 should point up for 2 reasons:

ambient light tends to come from above, and thus downward facing sensors 150 will be less adversely affected by the ambient light that might otherwise result in false triggering of musical notes;

light sources 120 have the advantage of being visible to the user when they are facing upwards.

Obviously a cover may be used to shroud each of the lights, but it is nice to be able to operate the apparatus with the covers off to see what is happening inside, or to use partially transparent covers for epistemological or experimental reasons or pure aesthetics. Of course additional lighting may be used in a playing on the instrument, and this includes lights on the instrument as well as elsewhere. For example, nine external MIDI controlled or computer controlled stage lights may be used, one for each note, so that a single solo performer may run an entire virtual band, and lighting console, while singing. A virtual band may be indexed through so that the user plays the lead role (while singing), on the apparatus of the invention. The entire band may be orchestrated by processor 140, such that all the instruments automatically adjust in time with the lead music from the user.

A satisfactory photocell is a cadmium sulphide photoresistor such as the kind used in dusk to dawn electric eye lights. Such a photocell may be connected directly into the matrix of most musical keyboards to activate a note, since flow results in light diverted to an otherwise baffled photocell, and since light results in less resistance (more conductance), which is like pressing a key on a keyboard.

The same is true of computer keyboards, so the apparatus can be directly connected for water typing or playing music with little or no interface hardware or power supply needed by the input device itself, other than for light, which could, in principle, be just ambient light if the photocells were moved down to the bottom. However, in preferred embodiments, for resistance to moisture effects, a lower impedance threshold is desired, and for other reasons (e.g. more bits of amplitude control) an active powered system is preferred. In some preferred embodiments, directional photodiodes or phototransistors are used for sensors 150. Typically a 7 bit precision is used to quantize the amount of flow, although greater precision and a lookup table are sometimes desired, to shape the amplitude response of the instrument comparametrically. The displays for note labels 312 on each note are preferably square computer displays, so they adapt well to a comparagram editor, for setting the note's amplitude response.

In other embodiments, an additional vision sensor overall such as an overhead camera for all nine jets or an additional sensor on each jet, or a different design is used to measure direction of water spillage, slappage, etc., so that the jets can be played more expressively. For example, to play along while singing the word "don't" in "hush little baby, DO-N'T you cry" or "standing" in "with mommy and daddy standing by" (Summertime, 1935), one presses down on the the high C jet and sweeps the water to the left, toward Bb, prior to laying into the Bb from the other direction. The result is the nice sounding down-chirp that so expressively captures the closing words of the the lullaby.

Figure 5:
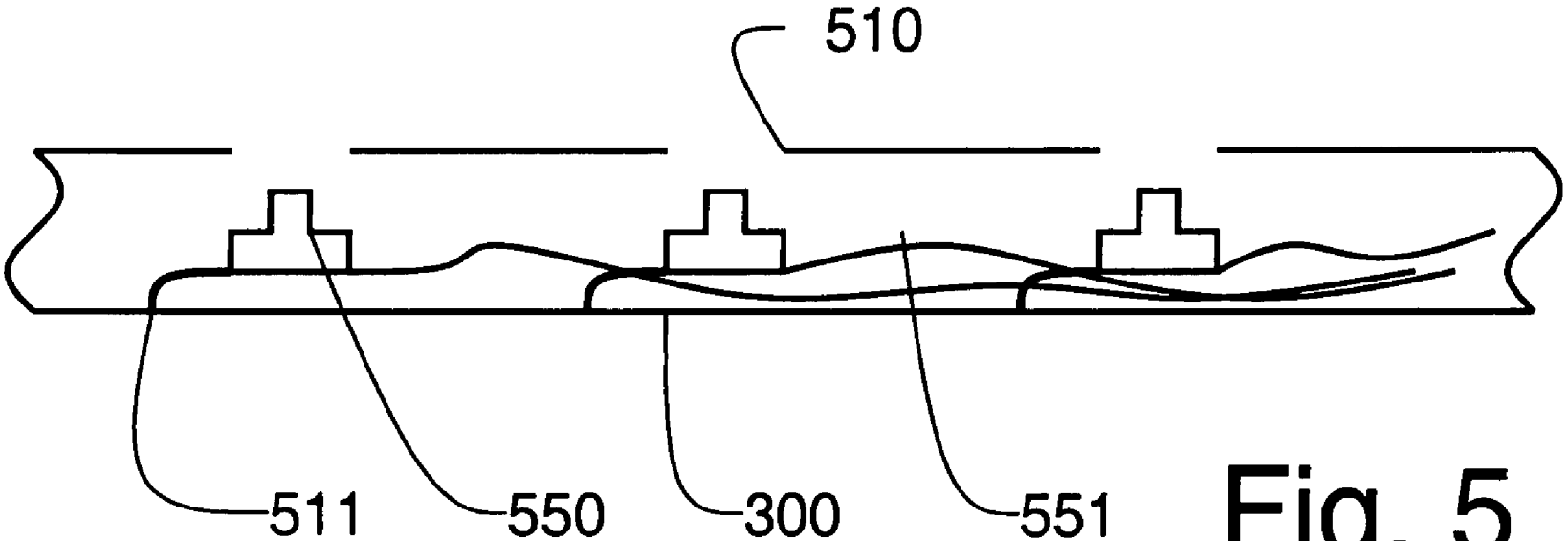
FIG. 5 illustrates an embodiment built inside a pipe such as a torus swim ring, inner tube, or other fully enclosed housing.

FIG. 5 is a diagram depicting a multi-jet liquid user interface fully contained inside a copper pipe manifold 300. This provides a very simple aesthetic in which the instrument becomes a nice looking copper sculpture.

Sensors 550 are simply pressure switches rather than optical sensors. An acceptable sensor is a miniature version of something found in a Reznor duct furnace for checking to make sure the air is flowing through the duct before the natural gas is switched on. Any switch in the sensitivity range from 1 to 20 inches of water column will work quite well. The switches of sensors 550 and wiring 551 are inside the manifold 300. Holes 510 in front of each port of sensors 550. Water pressure supplied to the pipe forces water out all of the holes, creating a vacuum on all of sensors which keeps them from activating, except when a user wishes to block one or more of the holes in which case positive pressure activates sensor 550 to produce a user input. Preferably sensors 550 are back vented by vents 511 so they can see atmospheric air pressure as a reference pressure.

The resulting embodiment with holes 510 can be played like a penny whistle, tin flute, or other similar wind instrument, except that it is a water instrument interface played by blocking water from coming out of certain holes. In particular, the processor 140 can be programmed to operate so that hole fingering is that of any preferred instrument of that type. Instead of the circular manifold 300, a straight manifold can be used, and the different size holes of a penny whistle or tin flute can be used, and thus preserve the familiar fingering of that instrument.

Figure 6:
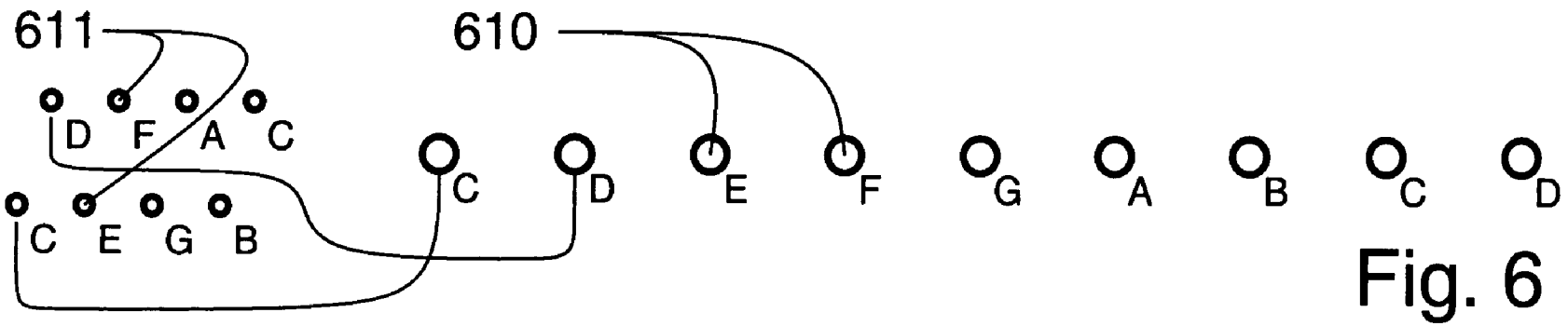
FIG. 6 illustrates a diversion of fluid for expression of subtle inputs through partial parallel streaming media.

FIG. 6 shows how water may be diverted from main jets 610 to smaller side jets 611, so that a more immersive multimedia input device may thus be created. For example chords may be activated with one finger, by blocking multiple jets at the same time. By skipping by twos, harmonious groupings are possible so that sloppy fingering results in good sounds that harmonize well, in much the same way that a harmonica is designed so that sloppy playing results in good sound by blowing through adjacent holes to get harmonious sounds.

Thus in this embodiment of the invention, harmonious groupings of of nozzle jets 611 facilitate easy chording.

Figure 7:
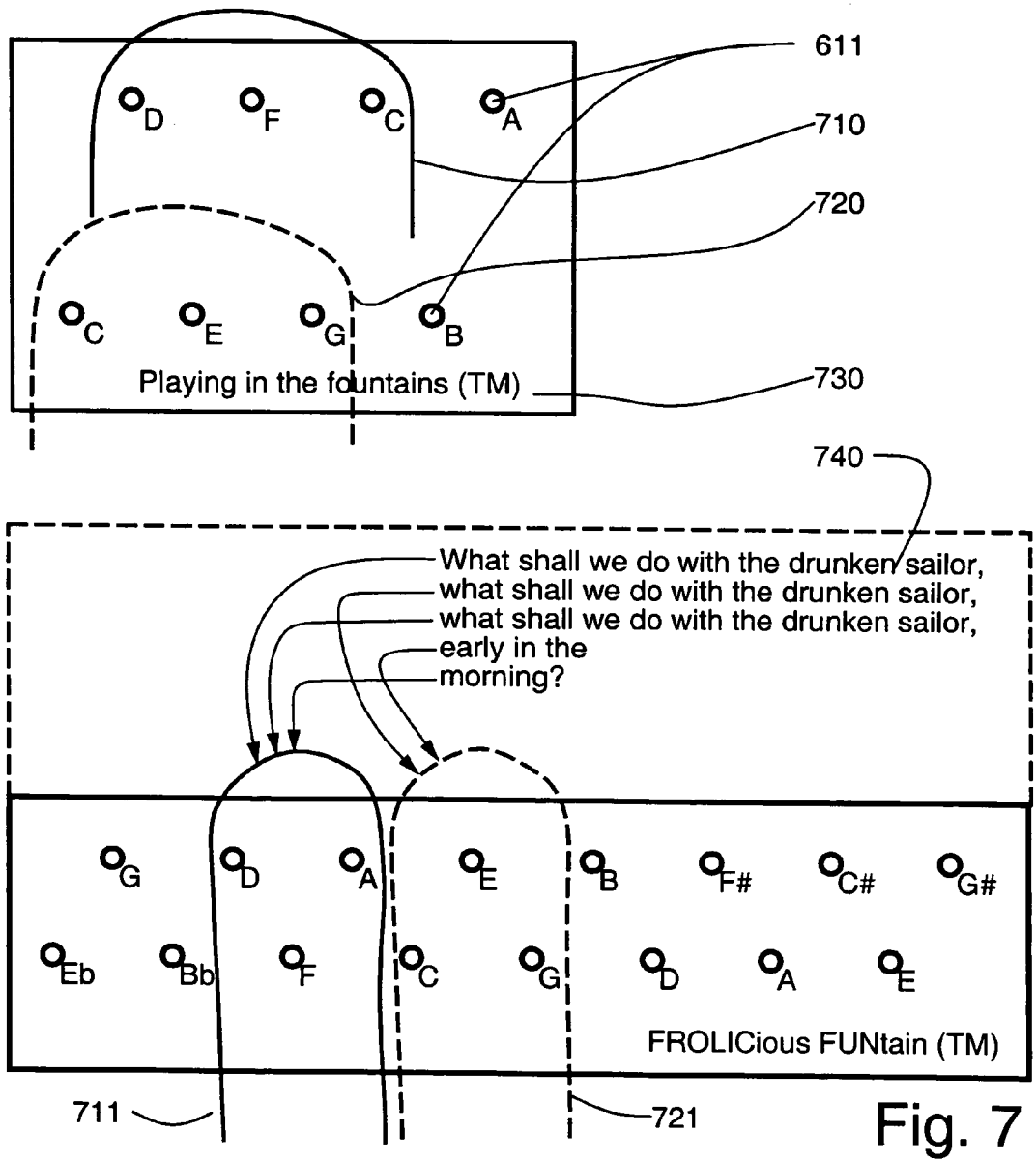
FIG. 7 illustrates the principle of multi-jet fingering.

FIG. 7 shows some examples of fingering positions for a popular song "What shall we do" (song of unknown authorship). Words to the song, chord suggestions, etc., or product information such as labeling (e.g. "Playing in the fountains (™)" may be displayed in display field 730.

Multiple jets 611 can be simultaneously covered with one finger 710, to make a D minor chord. Finger 710 is shown as a solid line. By moving over and down, the second row of nozzles can be activated in similar grouping to get a C-Major chord with finger 720. A drawback of this design is that it is hard to get to the top row without affecting the bottom row slightly, especially when jets 611 shoot high.

Accordingly, preferably nozzle groups are brought closer together and re-arranged, so that fingertips can be inserted into the spray. Finger 711 plays a D minor chord, and any three jets in which there is one jet closest to the user plays minor. Any three jets with two toward the user plays major, such as the C Major of finger position 721. A display area 740 prints the words to the song and shows fingering positions for teaching mode.

Figure 8:
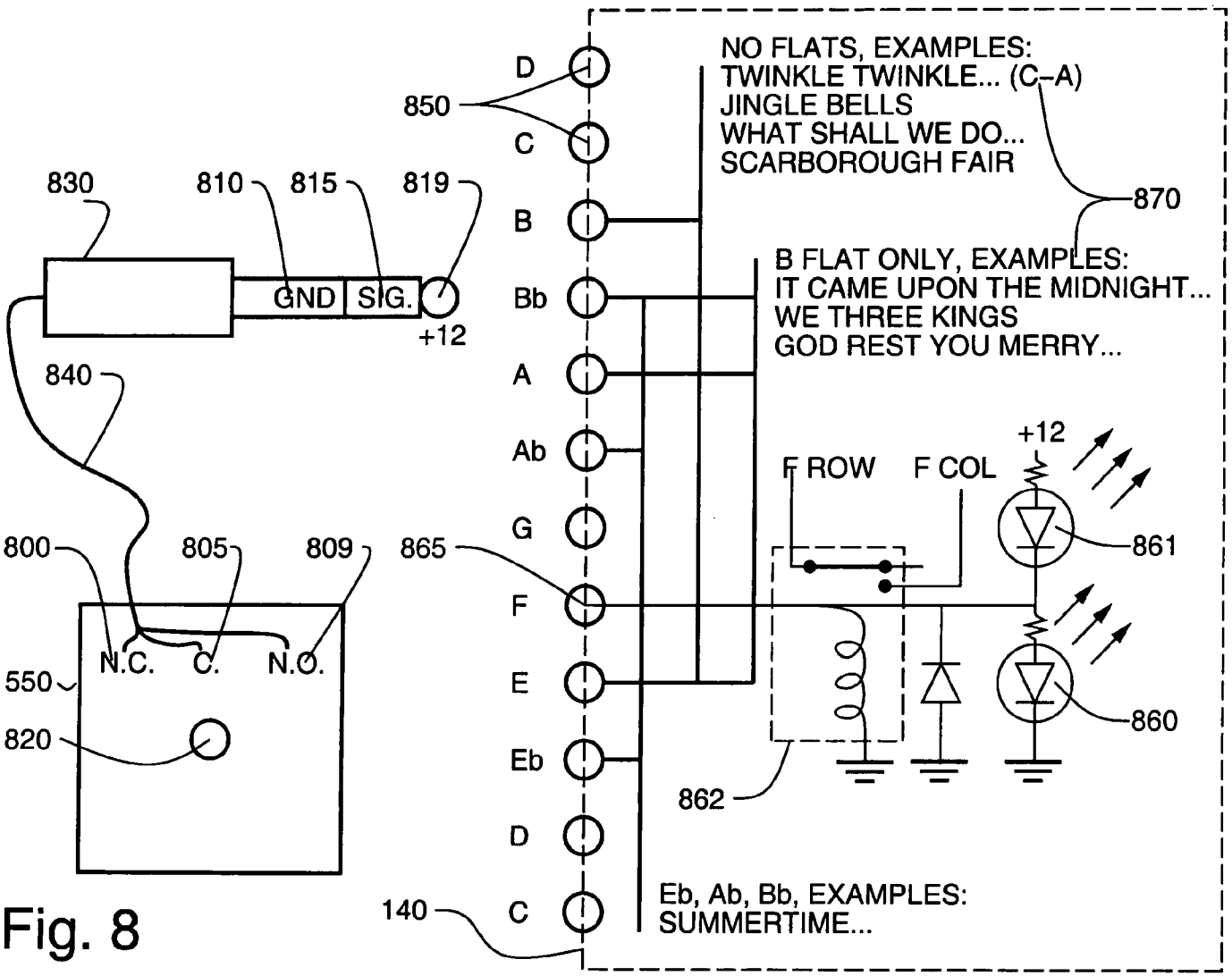
FIG. 8 illustrates a very simple way in which simple low cost sensors and wiring can be made immune to the effects of water conductivity, as well as a simple embodiment of the invention for use by inexperienced users.

FIG. 8 shows an example of a very simple embodiment, more of an illustrative early embodiment than the preferred embodiment, since it shows some aspects of the invention in a way that is easy to understand. For simplicity (but not to suggest it is the preferred embodiment) the input device of FIG. 5 is considered for sensor 550 shown. Ordinarily, a naturally open or naturally closed switch sensor 550 would bridge over and give erroneous results due to conductivity of treated water. Thus to attain immunity to water conductivity, sensor 550 is has both its naturally open (N.0.) contact 809 as well as its naturally closed (N.C.) contact 800 in use, in addition, of course, to its common (C.) contact 805. These contacts are connected respectively to the ground 810, middle 815, and tip 819 of a stereo ¼ inch plug 830 by wire cord 840. Cord 840 is preferably a round flexible black wire in which the ground is a shield around the other two wires.

A number of jacks (sockets) are provided for the insertion of a number of plugs 830. The number of plugs 830 is typically equal to the number of jets which is typically 9 for a simple instrument that can be played by children or inexperienced users, though more sensors may be used for more complicated pieces.

The 9 plugs 830 can be plugged into some of the sockets 850 on processor 140 to select a key in which to play. For example, to play in C-Major, or D dorian minor, the nine plugs are inserted into the C, D, E, F, G, A, B, C, and D sockets 850. The 3-wire interface allows processor 140 to detect which notes are plugged in and to display this information such as on LED 861, or alphanumeric or computer display 870. One way for processor 140 to display its knowledge of which sensors were plugged in, is for it to display some possible songs that can be played in the key so selected.

Light source 861 will illuminate when the input line 865 is pulled low by plug 830 connection from middle 815 to ground 810. This connection will also very decisively short the coil of relay 862, to definitely keep it off.

At this point, blowing into port 820 of sensor 550 will test the system and play a note, so even without the availability of water, the instrument can be tested by blowing into the holes of each note. Blowing into port 820 will cause contact 805 to disconnect from contact 800 and then to connect to contact 809. This will lift the coil of relay 862 to energize it, along with energization of the LED 860. Preferably there are similarly two LEDs inside each jet 310, and preferably the LED 860 that is on when the jet is blocked is red, and the LED 861 that is on when the jet is not blocked is green. When the jet changes color to red, it will still be visible through the flesh of the user, since flesh is more red in color than green. Moreover, in transmission, flesh is very red (i.e. it is somewhat translucent in the red). Thus the finger on the blocked jet 310 will be visible in red to affirm as a form of visual feedback that the instrument is working and has responded. This is useful when using a music synthesizer with slow attack, so that the user can know exactly when a note is actuated, i.e. that the jet 310 has been blocked or depressed enough to be considered a note-on, prior to even hearing the note.

It is essential to have a break before make type of switch, to avoid shorting the power supply, but most pressure switches are of this type. Preferably the switch can be modified to remove hysteresis or deadband, so that it can function as a velocity sensing switch, so that processor 140 could determine how fast the water jet is blocked, to adjust the amplitude of the musical note in response to how hard each jet 310 is hit. However, this feature is not shown in the simple relay embodiment in processor 140, in order to make the diagram simple. In implementation this velocity is found. (calculations in processor 140) by computing the time between break and make.

Figure 9:
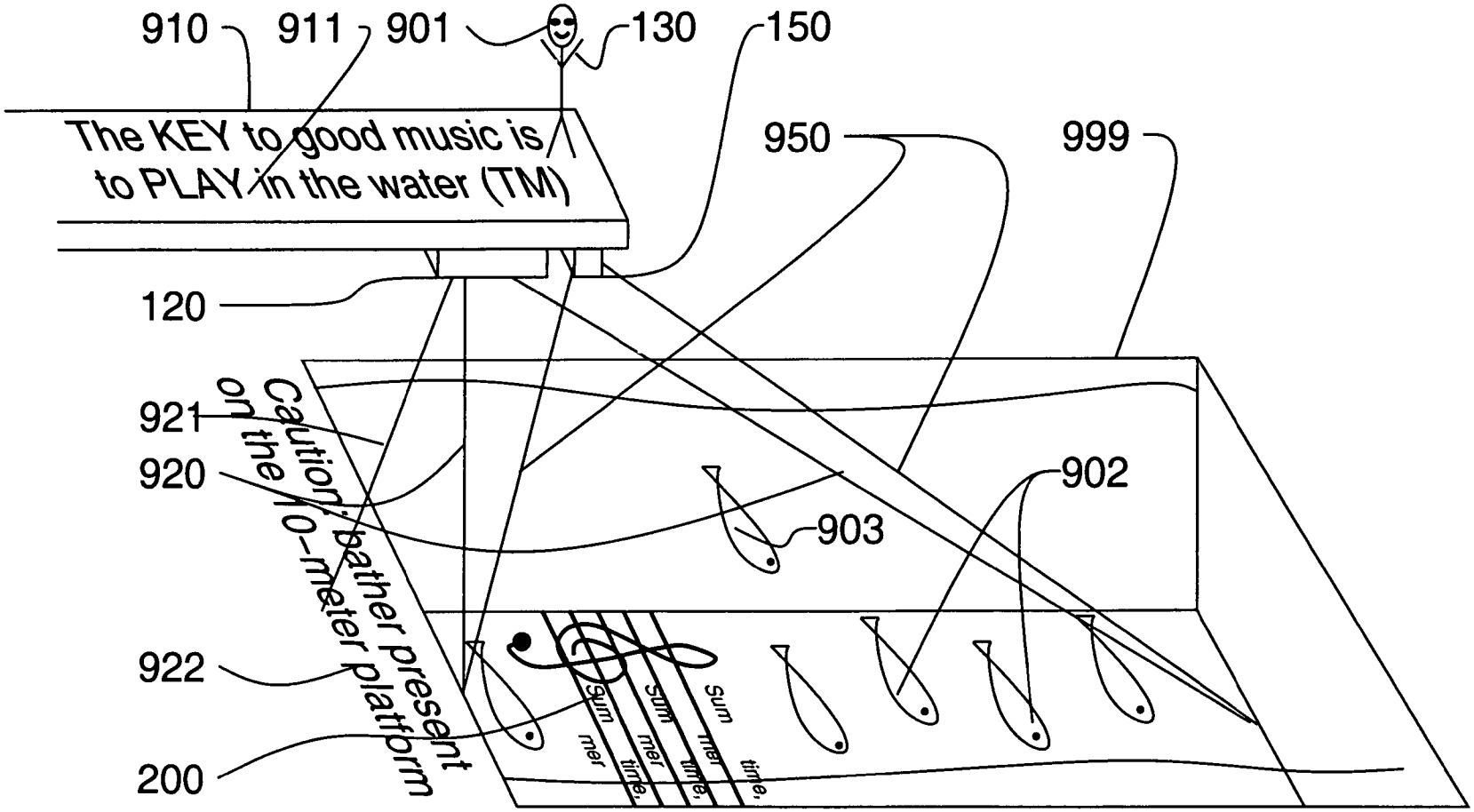
FIG. 9 illustrates a platform embodiment of the invention that is a fully and totally immersive multimedia environment.

FIG. 9 depicts a platform 910 for immersive multimedia, with a fluid user interface in which the user's entire body, not just his or her fingers, is used in the immersive multimedia input device. This embodiment of the invention may be installed at a municipal swimming bath 900 where there is a tower, or at locations without a tower, since it is also possible for people to enter from a springboard, or even to enter just by jumping off the side of the pool (0-meter platform) or to interact by frolicking in the pool, or with similar immersive multimedia in a lake or ocean.

In the embodiment shown, the user 901 climbs the tower, up onto the platform 910. A satisfactory platform is the standard 5-meter platform (for approximately 1 second in the air, and 36 km/hour speed of entry into the water user interface) or 10-meter platform (for approximately 1.4 seconds in the air, and 50 km/hour speed of entry into the water user interface) that may be found at many municipal swimming baths, university pools, and the like, as are often referred to as "olympic pools" (because entering a pool from a height of 10 meters is an olympic event, as well as a form of recreation for children).

A fun and playful splash screen or splash page 200 is projected from a light source 120 hung from the bottom of the platform, as projected rays 920 that span all or some of the pool area. Most platforms are cement with railings made of structural pipe fittings with size 8 being the most common size of structural pipe fitting found on platform railings. Various fittings commonly used in the theatrical lighting industry may be used to temporarily attach light source 120 to the bottom of the platform with appropriate rigging, using Alvin pipe clamps (e.g. from Alvin Industrial Sales in Canada). Standard safety procedures for rigging are used, i.e. safety chains on the light source in case it works loose over the years when a temporary one-day installation might be kept for 10 or 20 years in change of mind. A satisfactory light source for this embodiment of the invention is a high power data projector, or a laser based vector graphics projector. The projector projects streaming media such as a scrolling sign of splash page 200, with the words rolling down the musical scale, so that user 901 can select a key in which to later play the music. The user 901 selects the key by departing from the platform.

When departing from a platform, bathers typically insert their hands into the pool 999 first, so that the water hits them from above. In this way the user's body is upside down at time of impact, so that, all things being relative, in human-centered coordinates, the water in the pool pours down on top of the user. This water-from-above results in an experience similar to (though much more extreme) a shower, where water falls down on top of a person.

In this case, usually the hands 130 of user 901 will be the first body part to hit the water (hands are usually extended to cut through the water to avoid getting hit on the head with the water).

Optical sensor 150 has a field of view that includes rays 950 to see some or all of the pool 999 water surface and below, and is arranged to detect when and where the user's hand 130 hits the water. This point of contact selects from the splash page 200 in a manner similar to that shown in FIG. 2, except that the wall of water or sheet of water of FIG. 2 is now laid out flat and is the surface of the pool 999.

In addition to being a splash page for streaming media, the pool 999 also functions as an immersive multimedia environment, because the sensor 150 can continue to observe user 901 in descent into the water, and the manner of entry can be used to select or affect options, or can be otherwise used as a fluid user interface (i.e. as an input device) to a computer processor 140 or other input system or systems of the invention.

The top of the platform 910 may also be used as a display surface 911, to display messages for the bather, such as cautionary notes if the system observed that bather in a suboptimal entry on a previous try, or to display emergency messages, since it is hard to hear lifeguards, etc., from way up on the platform. When surface 911 is not being used for emergency messaging, it may display fun product information such as shown, "The key to good music is to play in the water (™)".

In one application, this embodiment of the invention may be used to set the key of another instrument in a water park, for example. Thus a user can use the 10 meter platform as an input device to choose the key that a nearby fountain will then play in. This creates a fun and playful way of having an input device for setting parameters for playing music.

Additional multimedia spaces include areas around the pool. For example, when the system detects the presence of a bather on the tower (i.e. on the way up) or up on the platform, a cautionary message on deck surface 922 may be projected to warn other bathers not to enter the pool at that time. This feature may be added simply by extending the field of coverage of light source 120 so that it includes rays of light to ray 921.

In addition to the splash screen of splash page 200, other playful elements may be included. For example, a fish-based screen saver may operate at idle times, or interactive gaming elements 902 may be displayed on the bottom of the pool. Various games include "catch a fish" in which a user needs to land on a fish, as well as "avoid the fish" in which a user needs to not land on a fish. The latter game is preferable to the former, to teach bathers the safety skills of avoiding collisions with other bathers.

Splash pages 200 may be projected on the bottom of the pool, or on the surface, or simultaneously on both, or on various intermediate mid-water areas, through the use of focus, and the like. A large aperture projector can have limited depth of field, and when a black background with light colored lines is used, it can focus on the bottom without affecting the surface, or vice versa. Two projectors, one for surface, and one for bottom can also be used together. Thus surface game elements such as element 903 may be combined with bottom game elements 902.

To enhance surface visibility the bubbler feature of most pools can be switched on or modulated. Many swimming baths have bubble jets to reduce the severity of impact when bathers land poorly, and these bubbles could be modulated as projection surface. To make the immersive multimedia interactive, the bubble jets can be dynamic, with the splash pages 200. Also, if visibility of the bottom is desired, the bather can be tracked, and a burst of bubbles delivered just before the bather hits that water.

This results in loss of visibility of the bottom on the descent, but this is not such a bad thing. Bathers generally learn that looking down into the water, whether in head first or hands first entry, often results in two black eyes and a badly bruised face. Thus it is even desirable in the invention to blank out the splash screen 200 (such as by turning off light source 120) as soon as a bather departs from the platform.

Where light source 120 is part of the vision system for sensor 150, and the blanking feature is desired, the light may change to infrared or other invisible light source during the blanking interval, or for the whole time so as not to rely on visible light.

The baths are a very social place, and particularly the towers, since the sequentiality of bathing is there mandated by safety, so that bathers line up to use the platforms, and there is time for idle chat while standing in line. Additionally, the serialization of bathing (sequentiality) gives rise to a phenomena in which bathers are each on display upon the elevated platform, one at a time.

The invention can thus be used for adding fun, games, music, or other multimedia elements to such ritualized or social bathing.

The pool 999 need not be limited to a rectangular olympic style pool. For example, a round pool could be built, with an offset platform that hangs over it like the tone-arm on a record player. A projection of a spinning roulette wheel could then be the streaming media of splash page 200, such that user 901 becomes the roulette ball. In this way, a person could place a bet by entering the pool. Processor 140 determines the landing time and place of the first part of the bather's body, and the spinning of the roulette wheel then would stop exactly when user 901 hit the water. By continued display of a stationary roulette wheel, the user and others could wait in suspense until the water ripples from the splash of the bather fade out, to reveal a clear image of where the bather hand landed on the virtual wheel. This adds the thrill of the platform to the thrill of gambling, and turns a fun and silly game like roulette into a fun and silly and splashy game.

Figure 10:
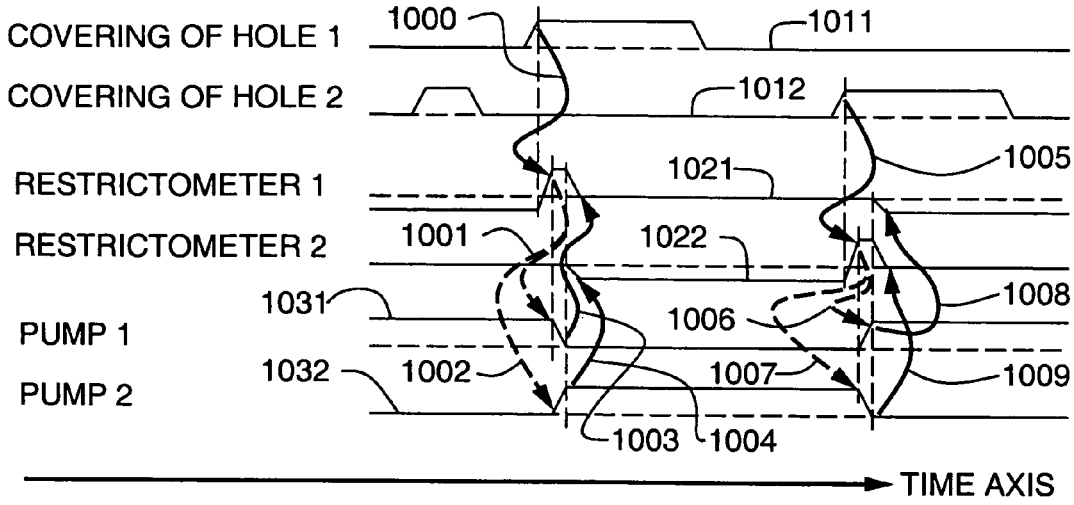
FIG. 10 illustrates the timing diagram for an embodiment of the invention that uses two jets to display, as well as to alter a one bit state setting, or to interact (e.g. to have a watertight across cyberspace, to push water through the internet and out the other side, etc.).

FIG. 10 depicts the timing diagram for a two-jet embodiment of the invention that can be used to both set and display state. Initially only one of the two jets is on. When the user pushes down on the jet that's on, the jet goes off, and the other jet goes on.

Pressing down on the active jet will cause it to turn off, and cause the other jet to come on. There are thus two states that the system can be in:

state 1: jet 1 is on;

state 2: jet 2 is on.

Thus the fluid medium can be used as both an input device, and an output device. Input is obtained by pressing a jet. Output is obtained by feeling the jets or, in the case of water, looking at the jets.

In the figure, the system is shown initially in state 1, i.e. jet 1 is on, and jet 2 is off. Timing diagram 1011 shows when the hole of jet 1 is covered, e.g. when a user places his or her finger over the hole to restrict fluid flow out of the hole, if there is fluid flowing out of the hole. Timing diagram 1012 shows when the hole of jet 2 is covered. Timing diagram 1021 shows the output of a restrictometer measuring the restriction of flow from jet 1, whereas 1022 shows the output of a restrictometer measuring the restriction of flow from jet 2. In this case, each of these two restrictometers is made from the following two items:

a tee fitting; and a pressure sensor attached to the side discharge of the tee fitting.

fluid from each jet is passed through the straight portion of each of the two tee fittings.

Timing diagram 1031 shows when pump 1 is turned on, to spray fluid out of jet 1, and timing diagram 1032 shows when pump 2 is turned on, to spray fluid out of jet 2.

The bold curved lines with arrows show the cause and effect relationship of the timing diagrams apparatus of this embodiment of the invention. The bold curved solid lines with arrows show physical cause and effect relationships, and the bold curved dashed lines with arrows show computational (virtual, i.e. induced by, for example, a microcontroller) cause and effect relationships.

Initially, on timing diagram 1012, when hole 2 is blocked, nothing happens. This is because pump 2 is initially off. Blocking a jet that has no flow going through it results in no change in restrictometer reading.

Initially restrictometer 1 shows a slight negative value because pump 1 is running, and by way of the Bernoulli effect, a slight vacuum is drawn on the side discharge of the tee fitting.

Then, a little later, when hole 1 is blocked, sequence 1000 shows that when hole 1 is blocked, after a short delay, restrictometer 1 goes to a high positive value. A direct process (such as a flow switch and relay) or a computational process (e.g. by way of a computer or microprocessor control, microcontroller, or the like), is used in the invention to cause pump 1 to shut off, and to cause pump 2 to turn on.

A satisfactory microcontroller is the AVR manufactured by Atmel. Computational sequence 1001 shows that the signal is sent to pump 1 to cause it to go off after a slight delay. Computational sequence 1002 shows that the signal is sent to pump 2 to cause it to come on after a slight delay.

Physical sequence 1003 shows that, shortly after the time when pump 1 goes off, the restrictometric reading from restrictometer 1 falls to zero.

Physical sequence 1004 shows that, shortly after the time when pump 2 comes on, the restrictometric reading from restrictometer 2 goes negative, because of the Bernoulli effect on the side discharge of the tee fitting that now has fluid running through it.

Now we have a situation in which jet 1 is off, and jet 2 is on. Now, if a user blocks jet 1, nothing happens, but when a user blocks jet 2, physical sequence 1005 shows that, after a short delay, an output from restrictometer 2 swings strongly positive. This positive swing is sensed computationally, and an on signal is sent to pump 1, as shown in computational sequence 1006. Simultaneously an off signal is sent to pump 2, as shown in computational sequence 1007.

When pump 1 comes on, restrictometer 1 swings slightly negative, as shown by physical sequence 1008. When pump 2 goes off, restrictometer 2 falls to zero, as shown by physical sequence 1009.

This embodiment of the invention can be used by itself, for example, as a decorative on/off switch for a room light or table lamp. The table lamp may even be built into a decorative fountain that has the two jets in it, so that pressing down on a first jet 1 causes the the lights to turn on, and pressing down on jet 2 causes the lights to turn off.

If both jets are held down, this could cause the whole system to shut down into a non-recoverable state. This may be desired as a way to shut off the fountain, requiring it to be unplugged and plugged in again. It would, indeed, be a very intuitive way to shut the whole thing down. Alternatively, a special state could be entered in which both jets come on together and stay on together.

As another use of this embodiment of the invention, instead of having the lights in the room mimic one of the jets (e.g. having the lights go on when jet 2 goes on), this embodiment of the invention can be used with other musical embodiments of the invention to select stops, like in a pipe organ. Pipe organ stops are normally pulled out to activate them, but here the stops are jets that are pressed in.

For example, a musical sculpture may have 61 jets for the 61 keys of a five octave fluid-based "keyboard", along with two additional jets to the left, that are used to select sound stops. Pressing down on jet 1 might turn on a flute sound. Pressing down on jet 2 might turn on a trumpet sound. Thus the user can select from among flute or trumpet by pressing the two expression jets to the left of the 61 main jets of the instrument.

Moreover, a third state can be created, such that pressing down both jets at the same time causes both pumps to come on, so that both are running, giving a combined flute and trumpet mixture.

More than two jets can also be used for this purpose. For example, three expression jets may be used as follows:

```
To initialize: turn on pumps 1 and 2;
while (1) // i.e. then enter an infinite loop as follows:
if jet 1 is restricted, then turn off jet 1 and turn on or keep on jets 2 and 3;
if jet 2 is restricted, then turn off jet 2 and turn on or keep on jets 1 and 3;
if jet 3 is restricted, then turn off jet 3 and turn on or keep on jets 1 and 2;
end while
```

If desired, multiple jet presses can be detected, e.g. if jets 1 and 2 are held down together, the program senses that more than one jet is restricted, and the outcome is to cause only pump 3 to come on. If all three are held down, then the device could be shut down (all pumps off) with some other way required to revive it, or a special excetion could be made and all pumps could come on, to prevent an irreversible state transition.

Embodiments of the invention may also use proportional stops, e.g. pushing a stop down partway causes the pump to drop to some fraction of full flow, but not turn completely off either. In this way, the stops can be adjusted up or down in varying degrees.

In another application of the invention, one or more jets at one location can control one or more jets somewhere else. For example, pushing down on the jet of a fountain in Toronto can cause the jet to stay down, while turning on a corresponding jet of a fountain in Australia. Thus the apparatus of the invention creates the illusion of a solid rod of water passing through the earth, that, when pressed on one end, comes out the other end of the earth, and vice versa.

Figure 11:
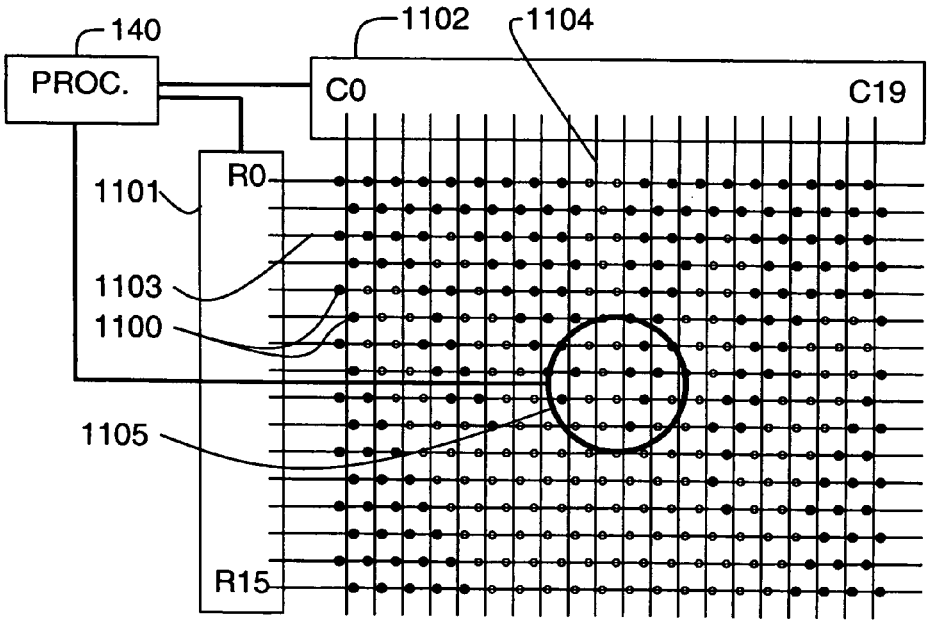
FIG. 11 illustrates a splash screen waterjet impression pad.

FIG. 11 depicts an embodiment of the invention having 320 jets (16 by 20 array of jets). This is enough jets to form a recognizable image in water, such as the impression of a hand pressing down on the jets. The 320 jets 1100 each consist of a hole drilled into a six inch (approx. 150 mm) blue plastic schedule 40 watermain pipe. The pipe is bent in a nice long arc, with 61 note jets on it, to play music, and the array of 320 expression jets is to the left of the note jets, so that a hand print can be used to set the expression (timbre, and other qualities of the sound).

If all the holes are equal in size then there is a problem with the jets that bend around the pipe being of greater pressure than the high and dry jets at the top of the pipe, so it is preferable to make a hole size profile, so that holes drilled at the top are a little larger than holes drilled toward the edges. As pictured, the top row, R0, of holes and the bottom row, R15 of holes are further around the pipe, but the middle rows between are high on the pipe, and thus the middle row holes should be made larger and the top and bottom row of holes smaller, and a profile of hole size created to even out the flow of water out of the holes.

An underwater video camera 1105 is mounted inside the pipe looking up at the holes. When a user puts his or her hand onto the array of holes, the camera can "see" which holes are restricted. In this case the camera functions as an array of restrictometers, so that it measures restriction of the various jets, optically. The processor 140 analyzes the video image from the underwater camera. The array pattern of the jets blocked can thus be used as musical expression to affect the sound.

In some embodiments of the invention, it may be desired for the expression pad to function as both an input and an output device. Row and column servos 1101 and 1102 serve the function of making the apparatus work as an output device.

Row servo 1101 drives row flapper wires 1103 which, in some embodiments of the invention are conductive wires affecting magnetic core flappers, that work like magnetic core memory with column flapper wires, to address individual jets.

In other embodiments of the invention, flapper wires are stiff stainless steel wires that actuate mechanical hole blockers, to turn on and off individual jets.

Column address flapper wires 1104 may curve around the pipe, and carry this mechanical motion along a curved trajectory. Alternatively, a flat surface may be used to avoid this matter.

The 320 jets are controlled as follows: For example, three expression jets may be used as follows:

```
To initialize: turn on all of the jets, then wait until some are restricted:
while (1) // i.e. then enter an infinite loop as follows:
    for (column=0:19)
        for (row=0:15)
            check region of camera to determine which jets are
            restricted;
            if flow of jet(row,column)=restricted, then engage flapper
            stop(row,column);
        end//for
    end//for
end//while
```

Here, restricted means that the ambient light from the outside world is restricted, so the restrictometer is measuring the flow of light.

If desired, the handprint can remain on the expression pad indefinitely, which has a very nice visual aesthetic, in which the very liquid material of water can take on a permanent shape.

Alternatively a clearing function can be made that sustains the hand print only as long as there is no further restriction. Since there is some noise it would be preferable to set a restrictometric threshold that keeps the handprint there until someone starts to play with the expression pad enough that more than ten percent of the remaining jets are blocked, before the hand print is cleared.

Alternatively, a gradual dissolve can be applied that makes the hand print melt away after 2 or 3 minutes of inactivity.

In other embodiments of this invention, two expression pads can be used to communicate or play. For example, pressing down on an expression pad in Toronto might cause the hand print to appear in Australia on another expression pad there. Thus one can imagine that water jets to be long glass rods that pass through the center of the earth.

From the foregoing description, it will thus be evident that the present invention provides a design for a wearable display or camera viewfinder. As various changes can be made in the above embodiments and operating methods without departing from the spirit or scope of the invention, it is intended that all matter contained in the above description or shown in the accompanying drawings should be interpreted as illustrative and not in a limiting sense.

Variations or modifications to the design and construction of this invention, within the scope of the invention, may occur to those skilled in the art upon reviewing the disclosure herein. Such variations or modifications, if within the spirit of this invention, are intended to be encompassed within the scope of any claims to patent protection issuing upon this invention.

The invention claimed is:

1. A user interface, said user interface including:

a housing, said housing having a plurality of openings;

means for supplying pressurized fluid through said openings;

a plurality of restrictometers, each of said restrictometers supplying an electrical signal that is responsive to an extent to which fluid flow is restricted through a corresponding opening by a user of said user interface;

an output means responsive to input from said plurality of restrictometers.

2. A user interface, said user interface including:

a fluid supply;

a plurality of fluid jets;

a plurality of sensors to each sense interaction between a user of said user interface and fluid passing through said fluid jets;

an output means responsive to input from said plurality of sensors.

3. The user interface of claim 2 in which said output means includes a processor, said processor including a decision process, said decision process selecting from a plurality of symbols each in response to obstruction of one of said fluid jets.

4. An input device, said input device including:

one or more water jets defining a plurality of symbol areas;

at least one user sensor for sensing interaction between a user and water passing through said one or more water jets, said sensor for sensing which of said symbol areas a user interacts with;

a processor responsive to an input from said sensor, said processor for determining which of said symbol areas said user is interacting with and generating an output in response to said determining which of said symbol areas said user is interacting with.

5. The device of claim 4 in which said interaction is touch.

6. The device of claim 5 in which said one or more water jets is an upward directed water jet, and said symbol areas are regions of height.

7. The device of claim 6, further including a jet height controller, said jet height controller responsive to an input from said processor, an input signal to said jet height controller being derived in response to which of said symbol areas are selected.

8. The device of claim 7, including means for measuring location of said touch, said height being set equal to a height determined to be nearest said location, said height maintained at that level by way of a closed-loop controller.

9. The device of claim 6, further including a tactile jet controller, said controller responsive to an input from said processor, an input signal to said controller being derived in response to movement between said symbol areas, said tactile jet controller rapidly altering a user feelable aspect of said jet in response to the movement between said symbol areas.

10. A musical instrument based on the device of claim 6 where each of said symbol areas corresponds to a musical note, and said output is the sounding of a tone corresponding with said musical note.

11. The device of claim 5 wherein said one or more water jets comprises a plurality of water jets and further comprising a manifold for supplying said plurality of water jets, and wherein each jet defines one of said symbol areas.

12. A musical instrument based on the device of claim 11 where each of said symbol areas corresponds to a musical note, and said output is the sounding of a tone corresponding with said musical note.

13. A water keyboard based on the device of claim 11 where each of said symbol areas corresponds to a keyboard entry, and said output is the generation of a symbol corresponding with said keyboard entry.

14. The device of claim 13 in which said symbol is a discrete symbol with at least one additional attribute.

15. The device of claim 14 in which said attribute is the time at which said symbol is selected by said user.

16. The device of claim 14 in which said attribute is an attack time and a release time.

17. The device of claim 14 in which said attribute is an amplitude attribute, and in which said amplitude attribute is proportional to how far down said jet was pressed.

18. The device of claim 14 in which said attribute is an amplitude attribute, and in which said amplitude is proportional to the degree to which said jet was blocked.

19. A musical pipe organ flute comprising said user interface of claim 1 wherein said output means is for producing a unique sound in response to the restriction of each of said openings.

20. The musical fluid pipe organ flute of claim 19, further including a mouth input and an embouchure controller, said embouchure controller for affecting said fluid supply in response to said mouth input.

21. A user interface for use with a pressurized fluid, said user interface including:

at least one sensor to sense a plurality of modes of contact between a user of said user interface and said fluid;

a processor for processing output of said sensor, said processor including a decision process, said decision process selecting from a plurality of symbols each in response to one of said modes of contact.

22. A user interface for use with pressurized water, said user interface including:

a housing having at least one opening;

a water supply system for delivering pressurized water through said at least one opening;

at least one detector for detecting a change in water delivered through said at least one opening; and an effect controller responsively coupled with said at least one detector wherein when said at least one detector detects said change in water, said effect controller produces at least one effect.

23. The water flow control system of claim 22 wherein said at least one detector is a restrictometer, said restrictometer configured to generate a signal when said restrictometer detects a fluctuation in volumetric flow of water.

24. The water flow control system of claim 22 wherein said at least one effect produced by said effect controller is an auditory effect.

* * * * *